US010290932B2

(12) United States Patent
Takeuchi et al.

(10) Patent No.: US 10,290,932 B2
(45) Date of Patent: May 14, 2019

(54) GLASS ANTENNA AND VEHICLE WINDOW GLASS PROVIDED WITH GLASS ANTENNA

(71) Applicant: AGC INC., Tokyo (JP)

(72) Inventors: Shoichi Takeuchi, Tokyo (JP); Naoki Hashimoto, Tokyo (JP)

(73) Assignee: AGC INC., Tokyo (JP)

( * ) Notice: Subject to any disclaimer, the term of this patent is extended or adjusted under 35 U.S.C. 154(b) by 0 days.

(21) Appl. No.: 15/870,451

(22) Filed: Jan. 12, 2018

(65) Prior Publication Data

US 2018/0138586 A1 May 17, 2018

Related U.S. Application Data

(63) Continuation of application No. PCT/JP2016/071458, filed on Jul. 21, 2016.

(30) Foreign Application Priority Data

Jul. 24, 2015 (JP) ..... 2015-147255

(51) Int. Cl.

| | |
|---|---|
| ***H01Q 1/32*** | (2006.01) |
| ***H01Q 13/10*** | (2006.01) |
| ***H01Q 5/10*** | (2015.01) |
| ***H01Q 5/371*** | (2015.01) |

(52) U.S. Cl.

CPC ..... *H01Q 1/32* (2013.01); *H01Q 5/10* (2015.01); *H01Q 5/371* (2015.01); *H01Q 13/10* (2013.01)

(58) Field of Classification Search

CPC ..... H01Q 13/10; H01Q 1/32; H01Q 5/10; H01Q 5/371

See application file for complete search history.

(56) References Cited

U.S. PATENT DOCUMENTS 5,220,336 A * 6/1993 Hirotsu ..... H01Q 1/1271 343/713
5,264,858 A 11/1993 Shiina
5,355,144 A * 10/1994 Walton ..... B32B 17/10036 343/713
5,365,242 A 11/1994 Shiina
(Continued)

FOREIGN PATENT DOCUMENTS

DE 19923036 A1 12/2000
EP 2811573 A1 12/2014
(Continued)

OTHER PUBLICATIONS

International Search Report for PCT/JP2016/071458 dated Sep. 13, 2016.

*Primary Examiner* — Tho G Phan
(74) *Attorney, Agent, or Firm* — Foley & Lardner LLP

(57) ABSTRACT

A glass antenna arranged on a vehicle window glass includes a slot antenna formed by cutting out a conductive film; and a pair of power supply units for supplying power to the slot antenna. The slot antenna includes a power supply slot extended in a first direction and arranged so that the pair of power supply units straddle the power supply slot, a plurality of comb-tooth slots extended in a second direction, and a root slot extended in a third direction, the root slot being connected directly to the power supply slot or being connected to the power supply slot via a connection slot, and end portions of the plurality of comb-tooth slots being connected to the root slot.

18 Claims, 22 Drawing Sheets

(56) References Cited

U.S. PATENT DOCUMENTS

| | | | | |
|---|---|---|---|---|
| 5,489,913 | A | 2/1996 | Raguenet et al. | |
| 5,528,314 | A * | 6/1996 | Nagy | B32B 17/10036 343/711 |
| 6,201,506 | B1 * | 3/2001 | Endo | H01Q 1/1278 343/704 |
| 6,396,445 | B1 * | 5/2002 | Saitoh | H01Q 1/1278 343/704 |
| 7,129,904 | B2 * | 10/2006 | Chen | H01Q 1/38 343/795 |
| 7,586,452 | B2 * | 9/2009 | Li | H01Q 1/1271 343/713 |
| 9,553,359 | B2 * | 1/2017 | Kagaya | H01Q 1/1271 |
| 2003/0164800 | A1 | 9/2003 | Jordan et al. | |
| 2006/0125703 | A1 | 6/2006 | Ma et al. | |
| 2010/0053011 | A1 | 3/2010 | Kurashima et al. | |
| 2011/0057844 | A1 | 3/2011 | Watanabe et al. | |
| 2012/0154229 | A1 | 6/2012 | Kagaya et al. | |
| 2014/0231503 | A1 | 8/2014 | Arimura | |
| 2015/0357700 | A1 | 12/2015 | Kagaya et al. | |

FOREIGN PATENT DOCUMENTS

| | | | |
|---|---|---|---|
| JP | H05-199031 | A | 8/1993 |
| JP | H06-291530 | A | 10/1994 |
| JP | 2003-283230 | A | 10/2003 |
| JP | 2008-147750 | A | 6/2008 |
| JP | 2009-171017 | A | 7/2009 |
| JP | 2011-091780 | A | 5/2011 |
| JP | 2012-054915 | A | 3/2012 |
| JP | 2012-169896 | A | 9/2012 |
| WO | WO-2014/129588 | A1 | 8/2014 |

* cited by examiner

4

GLASS ANTENNA AND VEHICLE WINDOW GLASS PROVIDED WITH GLASS ANTENNA

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2016/071458 filed on Jul. 21, 2016 and designating the U.S., which claims priority of Japanese Patent Application No. 2015-147255 filed on Jul. 24, 2015. The entire contents of the foregoing applications are incorporated herein by reference.

BACKGROUND OF THE INVENTION

1. Field of the Invention

The disclosure herein generally relates to a glass antenna and a vehicle window glass provided with the glass antenna.

2. Description of the Related Art

Recently, with development of communication technology, a mobile terminal or the like is often brought into a vehicle, to perform communication between the vehicle and the mobile terminal or between the vehicle and the outside.

Moreover, a technology of a vehicle provided with a function of collecting information from outside by itself and of delivering information, termed as a connected car, has been proposed. In a connected car, by performing a two-way communication for data transmitted from the vehicle, such as a vehicle position, a vehicle condition, and a road surface condition and for information collected from outside, such as map information, traffic information and weather information, a telematics service such as traffic congestion moderation or driving support for enhancing an efficiency and safety of the vehicle is provided. Furthermore, the connected car is expected to provide a solution/service or the like as a tool (device) for enhancing convenience for a user such as a delivery service of music or moving picture.

With respect to a communication wave used for such a two-way communication, frequencies used as stipulated in respective countries are different. Moreover, even within a country, frequency bands used for respective carriers are different. Thus, an antenna corresponding to a broadband so as to receive a plurality of communication waves is desirable.

A technology of mounting a communication antenna on a vehicle roof, as illustrated in FIG. 1, so that a two-way communication function between the vehicle and the outside can be realized, has been proposed.

In the example illustrated in FIG. 1, on a roof 91 of a vehicle 90, an antenna unit 80 having a diversity structure that has a first antenna 81 and a second antenna 82 standing on a ground board 83 separated in a forward and backward direction of the vehicle 90 is mounted. The antennas 81, 82 are housed in a case 84.

Moreover, in an example illustrated in FIG. 2, a glass antenna 100 has been proposed, in which one end for a first radiation pattern 121 is coupled to another end for a second radiation pattern 122 of differing length, arranged in a V-shaped pattern with respect to a vertical direction of a glass surface, and a grounded pattern 110 is arranged below the V-shaped pattern 120 (See Japanese Unexamined Patent Application Publication No. H06-291530). In this example, as a frequency switching type glass antenna for an automobile telephone for corresponding to a plurality of frequencies, for example, electric waves of resonance frequencies of 800 MHz and 1.5 GHz are transmitted and received.

SUMMARY OF THE INVENTION

Technical Problem

However, in the example illustrated in FIG. 1 of Japanese Unexamined Patent Application Publication No. 2012-054915, an antenna unit 80 is projected from a roof 91, thus there was a possibility of affecting a design of a vehicle or an aerodynamic character.

Moreover, in the example illustrated in FIG. 2 of Japanese Unexamined Patent Application Publication No. H06-291530, because the glass antenna 100 is configured of two elements for a radiation pattern 120 (121, 122) and the grounded pattern 110, a wide space for arrangement is required.

Furthermore, in the example illustrated in FIG. 2, because the radiation pattern 120 is from a linear metallic conductive wire, in order to avoid an interference from a side edge part 710*d* of a vehicle chassis on which a window is arranged and an interference from a defogger arranged on a rear window 600, the glass antenna 100 is required to be arranged separated by a predetermined distance from the side edge part 710*d* and the defogger. When the antenna is separated from the side edge part, the antenna becomes noticeable, and reduces appearance. When the antenna is separated from the defogger, a size of the defogger is required to be small, and a degree of freedom of design of the defogger is reduced.

In view of such a background, the present invention aims at providing a glass antenna and a vehicle window glass that improves appearance and can perform broadband communication.

Solution to Problem

In order to solve the above-described problem, an aspect of the present invention provides a glass antenna arranged on a vehicle window glass including a slot antenna formed by cutting out a conductive film; and a pair of power supply units for supplying power to the slot antenna, the slot antenna including a power supply slot extended in a first direction and arranged so that the pair of power supply units straddle the power supply slot, a plurality of comb-tooth slots extended in a second direction, and a root slot extended in a third direction, the root slot being connected directly to the power supply slot or being connected to the power supply slot via a connection slot, and end portions of the plurality of comb-tooth slots being connected to the root slot, and a vehicle window glass provided with the glass antenna.

Effect of Invention

According to an aspect of the present invention, in a glass antenna arranged on a vehicle window glass, it becomes possible to improve appearance and to perform broadband communication.

DETAILED DESCRIPTION OF THE PREFERRED EMBODIMENTS

Figure 1:
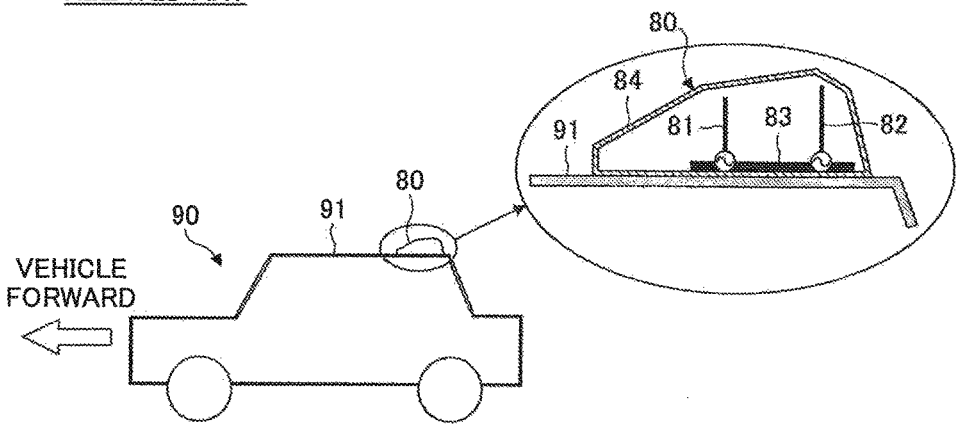
FIG.1 RELATED ART
FIG. 1 is an overall view depicting a vehicle in which a communication antenna is arranged according to a related art 1.

In the following, with reference to drawings, embodiments for implementing the present invention will be described. In the drawings for describing embodiments, in the absence of a specific description with respect to a direction, a direction refers to a direction on the drawings. Moreover, the drawings are drawings when viewed facing a surface of a window glass, and drawings may be viewed from the inside (or viewed from the outside) in a state that a window glass is mounted in the vehicle. A right-left direction (transverse direction) on the drawing corresponds to the horizontal direction, and an up-down direction corresponds to the vertical direction. The drawings may be referred to as drawings viewed from the outside.

For example, a window glass according to the present invention is mainly a rear glass mounted in a rear part of a vehicle, and a right-left direction on the drawing corresponds to a vehicle width direction. Moreover, a direction, such as parallel, or orthogonal, or the like allows a deviation enough to keep the effect of the present invention.

Figure 3:
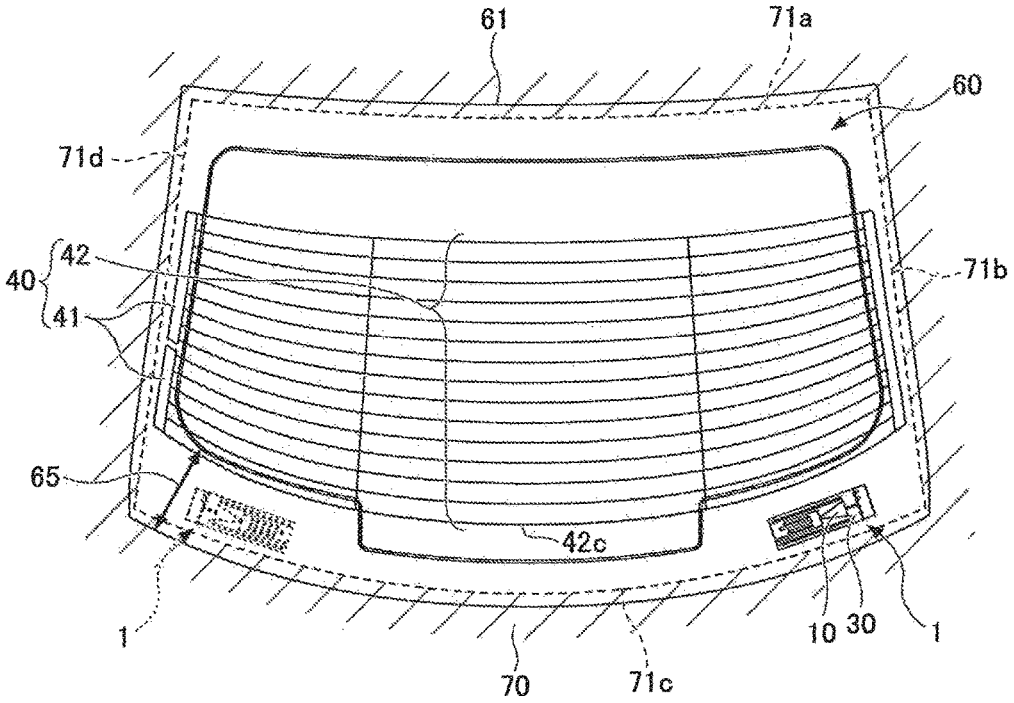
FIG. 3 is an overall plan view depicting a rear window glass in which a communication glass antenna according to an embodiment is arranged.

FIG. 3 is an overall plan view depicting a rear window glass in which a glass antenna 1 is arranged. The glass antenna 1 is an example of a vehicle antenna according to the embodiment, and functions as a communication glass antenna.

Moreover, in the present invention, a window glass is an example of a window plate covering an opening of a vehicle body. The window glass is a member having a plate shape. A material of the window glass is not limited to a glass, but may be a resin, a film or the like. A window glass 60 in the vehicle in the rear of the vehicle (also referred to as a vehicle window glass or a rear glass) is mounted on a chassis opening (also referred to as an opening or a window opening) formed of a vehicle chassis (a body or a vehicle body). An outer periphery 61 of the window glass 60 is indicated by a solid line in FIG. 3. A vehicle chassis 70 (a vehicle body or a hatch back door made from a metal or partially from a resin, e.g. including a resin around the opening within a metallic frame) is provided with edge portions (body flanges) 71*a*, 71*b*, 71*c* and 71*d* forming the window opening of the vehicle (See dashed lines in FIG. 3).

In FIG. 3, the window glass 60 is developed in a plane. A lower edge portion 71*c* contacting the vehicle chassis 70 is indicated as a curve. When the window glass 60 is mounted in the vehicle, the lower edge portion 71*c* extends in the vehicle width direction, i.e. in an approximately horizontal direction. Thus, respective slots 21 to 24 of a comb-tooth slot 20, two-sided island shaped slots 18 (14, 15), and connection slots 19 (12, 13) (See FIG. 4) of the glass antenna 1, that are arranged approximately in parallel with the adjacent lower edge portion 71*c*, extend in the vehicle width direction, i.e. in the approximately horizontal direction.

The glass antenna 1, illustrated in FIG. 3, that is a vehicle glass antenna, is formed incorporated on one surface (particularly on a vehicle interior surface) of the window plate (window glass), by printing, embedding, adhering or the like. For example, the glass antenna 1 is configured by arranging a rectangular metallic film 30 that is a conductor in which a cutout portion 10 is formed (e.g. a conductive film formed by baking a silver paste or the like) on the vehicle window glass (rear glass) 60. Note that the conductive film of the present invention is not limited to a metallic film, and may be, for example, a conductive resin film.

The metallic film 30 is cut out into an elongated hole (making a slit), and radiation is performed from the cutout part as a slot. The glass antenna 1 functions as a slot antenna.

In FIG. 3, a black or brown shielding film (shielding part) 65 is formed in a periphery region on the surface of the window glass 60. On the shielding film 65, an entire antenna 1 is arranged. A part of the antenna 1 may be arranged. The shielding film 65 includes a ceramic film such as a black ceramic film.

Moreover, with reference to FIG. 3 as a drawing viewed from inside, when the metallic film 30 forming a slot antenna is attached on a surface of the window glass 60 inside the vehicle, all elements of the glass antenna 1 are arranged on the window glass 60 inside the vehicle. Furthermore, with respect to the glass antenna 1, a part in which at least a resistor 8 and a coaxial cable 8*c* (See FIG. 5) are installed, or the entire glass antenna 1, is arranged within a region of the shielding film 65.

In the case where the glass antenna 1 is arranged on the surface of the window glass 60 inside the vehicle, a component forming the glass antenna 1 does not exist on the surface outside the vehicle. Furthermore, because the glass antenna 1 is arranged on the shielding film 65, and the entire metallic film 30 or a part of the metallic film 30 is not viewed from outside of the window glass, the window glass is excellent in design.

Furthermore, the shielding film 65 may be formed with shielding dot parts in a portion off the vehicle chassis 70 so that the shielding gradually becomes thinner approaching the center of the window (with a gradation).

As illustrated in FIG. 3, on the window glass 60 that is a rear glass, a defogger 40 having a plurality of heater wires 42 which are parallel to each other and a plurality of belt-like bus bars 41 which supply power to the heater wires 42 may be arranged. The heater wires 42 and the bus bars 41 that configure the defogger 40 are electrically heating type conducting patterns.

In FIG. 3, the glass antenna 1 is arranged in the window glass 60 below the defogger 40, i.e. in a margin region between the lowermost heater wire 42*c* of the defogger 40 and a lower edge portion 71*c* of the opening of the vehicle chassis 70.

Even if the shape of the window glass is the same as the above, when for example, a rear support part of a backseat banks upward, a metallic part of the rear support part (including a part of a metallic body supporting the rear support part, a metallic frame part, or a metallic body part of a speaker embedded in the rear support part) may project upward relative to the lower edge portion 71*c* of the opening of the vehicle chassis 70, and may be arranged in proximity to the glass antenna. In this case, the glass antenna is affected more from the metallic part of the rear support part than the lower edge portion 71*c* of the opening of the vehicle chassis 70.

Thus, in the case of attaching a glass antenna 1 to a vehicle with a configuration that is liable to be affected by the metallic part of the rear support part, in the margin region between the lowermost heater wire 42*c* and the lower edge portion 71*c*, the glass antenna 1 can be arranged at a position that is above the position illustrated in FIG. 3, and adjacent to the lowermost heater wire 42*c* or at a position close to the center.

In any case, the glass antenna 1 is arranged, for example, at either a corner portion between the lower edge portion 71*c* of the opening of a vehicle chassis 70 and a side edge portion 71*b* continuing into the lower edge portion 71*c* (a part indicated by a solid line in the lower right position in FIG. 3), or near a corner portion between the lower edge portion 71*c* and a side edge portion 71*d* continuing into the lower edge portion 71*c* (a part indicated by a dotted line in the lower left position in FIG. 3).

Alternatively, in the window glass 60, the glass antenna 1 may be arranged adjacent to either of the left and right corner portions of the upper edge portion 71*a* of the vehicle chassis 70. In this case, the configuration is flipped top-bottom.

In descriptions of first to fifth embodiments, a configuration of the glass antenna 1 arranged at a lower right position indicated by a solid line in FIG. 3 will be described.

First Embodiment

Figure 4:
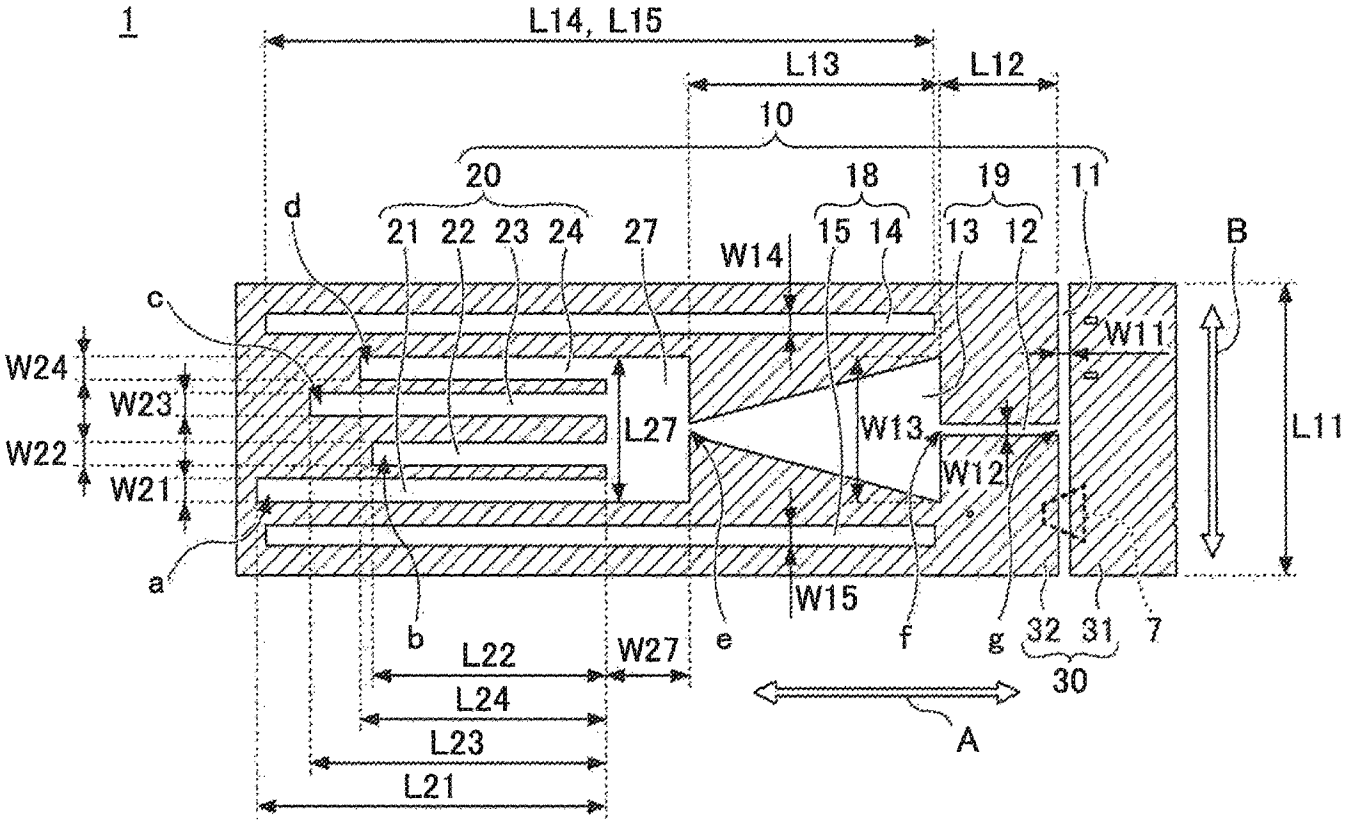
FIG. 4 is an enlarged view depicting a communication glass antenna according to a first embodiment.

FIG. 4 is an enlarged view depicting a glass antenna according to a first embodiment arranged on a vehicle window glass 60.

The glass antenna 1, in which a cutout portion 10 is formed in a metallic film (conductive film) 30, functions as a slot antenna.

Specifically, in the metallic film 30, a power supply slot 11, a connection slot 19, a root slot 27, a comb-tooth slot 20 and a two-sided island shaped slot 18 are formed as cutout portions 10. A pair of power supply units (power supply points) 7 are arranged so as to straddle the power supply slot 11.

In the embodiment, the power supply slot 11, on which the pair of power supply units 7 are arranged so as to straddle the power supply slot 11, extends in an approximately up-down direction (direction "B") as a first direction.

In the embodiment, the connection slot 19 extends in an approximately horizontal direction (direction "A") as a second direction that is different from the first direction, and connects the power supply slot 11 and the root slot 27.

The connection slot 19 is provided with a line-shaped linear connection slot 12 having a constant slot width connected to the power supply slot 11 at an end portion g (connection point g), and a triangular slot (triangle shaped slot) 13 arranged between the linear connection slot 12 and the root slot 27. The linear connection slot 12 extends in an approximately horizontal direction (fourth direction).

The triangular slot 13 has a shape of an isosceles triangle, in which a slot width on the side (end portion f) connected to the linear connection slot 12 is great, and the slot width gradually becomes smaller extending toward the root slot 27 (end portion e).

The comb-tooth slot 20 and the root slot 27 have shapes of a head portion of a fork, particularly a digging fork. The comb-tooth slot 20, having a shape of tip sections (claw sections or tooth sections) from the head portion of a fork, has a plurality of linear slots (tip slots) respectively extending parallel to each other in an approximately horizontal direction (direction "A").

The root slot 27, corresponding to a root portion of teeth from the head portion of the fork (fork-head portion), connected to end portions of the comb-tooth slot 20, extends in a direction different from the comb-tooth slot 20 (vertical direction, the third direction). Moreover, the connection slot 19 is connected to an extending portion of the root slot 27 other than an end portion (in the example illustrated in FIG. 4, an approximately central portion).

In the embodiment, the comb-tooth slot 20 is provided with a linear first slot 21, a linear second slot 22, a linear third slot 23 and a linear fourth slot 24. An end of the first slot 21 is a lower part comb-tooth slot (lower part tip slot) connected to a lower end of the root slot 27, and an end of the fourth slot 24 is an upper part comb-tooth slot (upper part tip slot) connected to an upper end of the root slot 27. Moreover, the second slot 22 and the third slot 23 are central part comb-tooth slots (central part tip slots).

Slot lengths of the first slot 21, the second slot 22, the third slot 23 and the fourth slot 24 are different from each other.

For example, the first slot 21 extends up to an end portion "a", the second slot 22 extends up to an end portion "b", the third slot 23 extends up to an end portion "c" and the fourth slot 24 extends up to an end portion "d". When the slot lengths of the respective slots in the comb-tooth slot 20 are denoted by L21, L22, L23 and L24, respectively, in FIG. 4, the slot lengths satisfy a relation L21>L23>L24>L22. In the case where the glass antenna 1 is arranged in the lower right portion of the window glass 60, the first slot 21 having the greatest slot length L21 is arranged in the lowest portion (close to the lower end portion 71*c*). By arranging the slot in this way, a directional characteristic of a low elevation angle direction with respect to the low frequency region can be obtained.

The island shaped slots 14, 15 are arranged so that the connection slot 19, the root slot 27 and the comb-tooth slot 20 are interposed in the vertical direction from both sides. FIG. 4 illustrates an example in which the island shaped slots 14, 15 have the same length. The lengths of the island shaped slots 14, 15 on the upper and lower sides may be different from each other.

Note that a corner of the slot may be a curve having a curvature. Moreover, the end portion may be a terminal end of an extension of the slot, or may be a neighborhood of the terminal end before the end portion of the slot.

The approximately upward direction means locating relatively above other end portions, and includes upward in the vertical direction and obliquely upward. The approximately downward direction means locating below other end portions, and includes downward in the vertical direction and obliquely downward.

For example, a mounting angle of the window glass 60 with respect to the vehicle falls, for example, preferably within a range of 15° to 90° with respect to a horizon plane. The up-down direction of the glass antenna is an up-down direction on a surface of the window glass, and have the same inclination as that of the window glass.

As illustrated in FIG. 3, in the case where the glass antenna 1 is arranged adjacent to a corner portion of the opening of the vehicle chassis 70, the respective slots 21, 22, 23 and 24 of the comb-tooth slot 20, the linear connection slot 12, the triangular slot 13 and island shaped slots 14, 15 are arranged approximately parallel to the adjacent lower edge portion 71*c*.

Thus, when the glass antenna 1 according to the first embodiment is employed, a longitudinal length of a space for arranging the metallic film 30 to be formed can be set small. Even if a defogger 40 occupies most of the window glass (rear glass) 60 in the up-down direction, the glass antenna 1 that is small in the up-down direction can be arranged in a small margin region of the window glass 60.

FIG. 3 illustrates an example in which the glass antenna 1 is arranged adjacent to a lower right corner portion of the window glass 60. The glass antenna 1 may be arranged in the lower left portion. In this case, the configuration is flipped horizontally. Moreover, in the window glass 60, the glass antenna 1 may be arranged adjacent to the upper edge portion 71*a* of the vehicle chassis 70.

In FIG. 4, the power supply slot 11 that extends in an approximately up-down direction has an opening upward and an opening downward.

In the metallic film 30, a part closer to the side edge portion 71*b* of the vehicle chassis 70, which is arranged adjacent to the metallic film 30, than the power supply slot 11 (right side in FIG. 4) functions as a ground side conductive body 31, and a part (left side) farther from the side edge portion 71*b* than the power supply slot 11 functions as a core wire side conductive body 32.

The pair of power supply units 7 supply power to the ground side conductive body 31 and the core wire side conductive body 32 at a position arranged so as to straddle the power supply slot 11. In the embodiment, the power supply unit 7 is arranged below a portion at which the power supply slot 11 is connected to the linear connection slot 12 and is arranged in the lower part of the metallic film 30.

Moreover, as illustrated in FIG. 4, in the glass antenna 1 according to the first embodiment, the core wire side conductive body 32 of the metallic film 30 is provided with a solid part with a great width (solid-fill part). However, when an area of the solid part is too great, difference between heat absorptions of glass and metal affects the formation of the glass, and a distortion may occur.

Thus, the above-described island shaped slots 14, 15 are arranged on both sides so that the width of the metallic film 30 can be increased while maintaining the formability of glass.

Moreover, the island shaped slots 14, 15 on both sides are also used for controlling the frequency used for communication.

Figure 5:
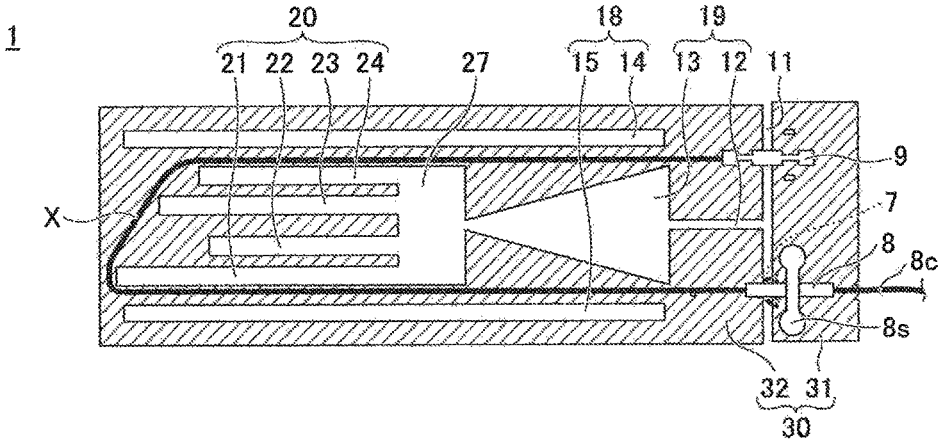
FIG. 5 is an enlarged view depicting an antenna obtained by arranging a resistor and a power supply unit in the communication glass antenna illustrated in FIG. 4.

FIG. 5 is an enlarged view illustrating a glass antenna obtained by arranging a resistor 9; and an on-glass connector for connecting coaxial cable 8 (in the following, simply referred to as a "connector") connected to a coaxial cable 8*c* at the power supply unit 7.

In the present invention, the ground side conductive body 31, the core wire side conductive body 32, the power supply unit 7, the resistor 9, the coaxial cable 8*c* and the on-glass connector for connecting coaxial cable 8 are arranged on one surface (the same surface) of the window glass 60 that is a conductive body, i.e. an indoor side surface.

In the embodiment of the present invention, as described above, the on-glass connector for connecting coaxial cable 8 is soldered with a solder 8*s* to the power supply unit 7 arranged so as to straddle the power supply slot 11. In the on-glass connector for connecting coaxial cable 8, an internal conductive body of the coaxial cable 8*c* is connected to and soldered to the core wire side conductive body 32. An external conductive body of the coaxial cable 8*c*, such as a braided wire, is connected to and soldered to the ground side conductive body 31.

In the antenna for communication that is a subject of the present invention, transmission and reception of information including a telematics service are performed. Because as a property of the telematics service, a real-time property and urgency are required, a connection state of network is required to be maintained. Thus, in the present embodiment, in order to detect at least a connection of an antenna, the resistor 9 for detecting connection may be arranged.

According to the above-described configuration, the ground side conductive body 31 and the core wire side conductive body 32 of the metallic film 30 form a closed circuit with a route that includes the resistor 9. The circuit is connected inside (internal conductive body) and outside (external conductive body such as the braided wire) of the coaxial cable 8*c*, which are connected to the connector 8 arranged at the power supply unit 7.

In the case where with the above-described configuration, a resistance value that falls within a predetermined range is not obtained for the circuit including the resistor 9 by a communication device (not shown) mounted in the vehicle and connected to the coaxial cable 8*c*, it is detected that an antenna is not connected and a communication cannot be performed.

Moreover, by arranging a resistor 9, a member indicated by X in FIG. 5 can function as a disconnection detection path for detecting a breakage of the vehicle window glass 60.

The ground side conductive body 31 and the core wire side conductive body 32 are metallic films that were formed by printing a paste including a conductive metal, such as a silver paste, on the vehicle interior surface of the window glass 60, and baking the paste. Note that the formation method is not limited to the above, a linear body or a foil-like body made of a conductive material such as copper may be formed on one surface of either of the vehicle interior surface or the vehicle exterior surface of the window glass. The conductive bodies may be formed by pasting on the window glass with an adhesive agent. In the case where the window glass is a laminated glass, the conductive bodies may be formed inside the window glass.

Moreover, because the window glass 60 is a rear glass, and typically a strengthened glass is used, when the window glass is broken, the window glass becomes fine granular fragments. When the window glass 60 is broken, the core wire side conductive body 32 and the ground side conductive body 31 in the state of silver paste printed on the window glass 60 also become granular fragments and are broken.

In the case where the disconnection detection path X is formed by connecting the core wire side conductive body 32 and the ground side conductive body 31 with the connector 8 connected to the power supply unit 7 and with the resistor 9, when a disconnection occurs in the disconnection detection path X, the value of resistance becomes infinity, and thereby a breakage of the window glass 6 can be detected.

Because the antenna according to the embodiment can detect a breakage of a glass by detecting a disconnection, it is not necessary to separately arrange a glass breakage detection means on the window glass 60. Because a number of parts arranged on the window glass can be reduced, a space for arranging an antenna and a glass breakage detection means can be reduced, and the appearance of the window glass is improved.

Furthermore, in the embodiment of the present invention, as illustrated in FIG. 5, on the power supply slot 11, the power supply unit 7 and the resistor 9 are proximally arranged across the connection point g to the linear connection slot 12. Thus, the on-glass connector for connecting coaxial cable 8 arranged at the power supply unit 7 and the resistor 9 may be integrated, and modularized. Thus, a mounting performance for arranging members is enhanced.

Figure 2:
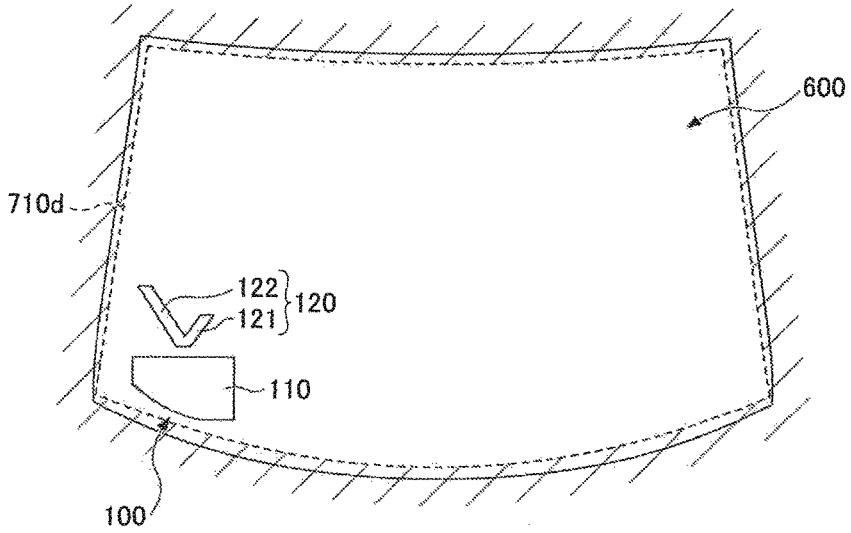
FIG.2 RELATED ART
FIG. 2 is an overall view depicting a rear window glass on which a telephone antenna is arranged according to a related art 2.

In the case where the vehicle chassis is made of a metal, when a radiating element of a linear antenna in a silver paste state is arranged at a position near the vehicle chassis or a position close to a defogger (related art, see FIG. 2), due to an interference with a metal, a reception gain for an antenna tends to be reduced.

In the embodiment of the present invention, for any of the embodiments illustrated in FIG. 4 to FIG. 10B being employed, the radiating element is a slot antenna; thus, an electric field, made by an electric current flowing inside the metallic film 30 forming slots, is formed in a closed form. Thus, the antenna according to the embodiment is not liable to be affected by the interference with a metal or a resin around the antenna.

For the antenna according to the embodiment, even if a metal, such as a defogger, a vehicle chassis or a rear support part, is in proximity around the antenna, or even if a resin part of the vehicle chassis is in proximity around the antenna, a stable characteristic can be obtained. Furthermore, even if a metallic film such as a transparent conductive film is formed around the antenna, an antenna that is not liable to be affected by interference can be formed in the same way as above.

Frequencies used for communication as specified by countries are different from each other. Even within one country, frequency bands used for respective carriers are different from each other. An antenna for accommodating a wide band so that a plurality of communication waves can be received is preferable.

For UHF (Ultra High Frequency) waves used for communication, the glass antenna according to the present invention is set to perform communication in, for example, three bands, 0.698 GHz to 0.96 GHz (Band 1), 1.71 GHz to 2.17 GHz (Band 2) and 2.4 GHz to 2.69 GHz (Band 3), among the bands used for LTE (Long Term Evolution).

Furthermore, the glass antenna according to the present invention is set to perform communication in an ISM (Industry Science Medical) band, as a frequency band used for communication. The ISM band used for communication includes 0.863 GHz to 0.870 GHz (Europe), 0.902 GHz to 0.928 GHz (US) and 2.4 GHz to 2.5 GHz (common worldwide). A communication standard using the 2.4 GHz band that is an example of the ISM band includes a wireless LAN of the DSSS method in compliance with IEEE 802.11b, Bluetooth (trademark registered), a part of FWA system and the like.

The ISM bands in US and Europe overlap with a band of the Band 1 of the LTE, and the ISM band common worldwide overlaps with the Band 3 of the LTE. The glass antenna according to the embodiment also can be applied to the ISM bands for communication.

Specifically, in the present invention, as a slot antenna, by forming a power supply slot 11, a connection slot 19 (12, 13), a root slot 27, a comb-tooth slot 20, and an island shaped slot 18 (14, 15) in the metallic film 30, a plurality of frequencies are accommodated.

In the glass antenna 1 according to the embodiment, a plurality of slots with different length and different widths are formed, and the antenna can accommodate a wide frequency band.

Furthermore, in field tests for communication service in recent years, in the low frequency band, the vertically polarized wave tends to be emphasized. Thus, in the embodiment, the respective slots 21 to 24 of the comb-tooth slot, the connection slot 19 (12, 13), and two-sided island shaped slots 18 (14, 15) extend in approximately horizontal directions. From a horizontal slot antenna, vertically polarized radio waves can be transmitted and received.

Thus, in the first embodiment of the present invention, in a mode of mounting a glass antenna, the respective slots are caused to extend in an approximately horizontal direction; moreover, in the low frequency region, mainly vertical polarized waves are accommodated. When the respective slots are caused to extend in an approximately vertical direction, the antenna can accommodate a horizontal polarized wave.

In this way, the glass antenna according to the embodiment of the present invention, without affecting a design of the vehicle or an aerodynamic characteristic, as in the related art illustrated in FIG. 1, and without deteriorating an appearance because the antenna is arranged near the outer periphery 61 of the window glass 60, can accommodate a plurality of bands and a wide frequency band. Accommodating the wide frequency band according to the embodiment will be described in detail in a practical example 1 with reference to FIGS. 11 to 20.

Second Embodiment

Figure 6:
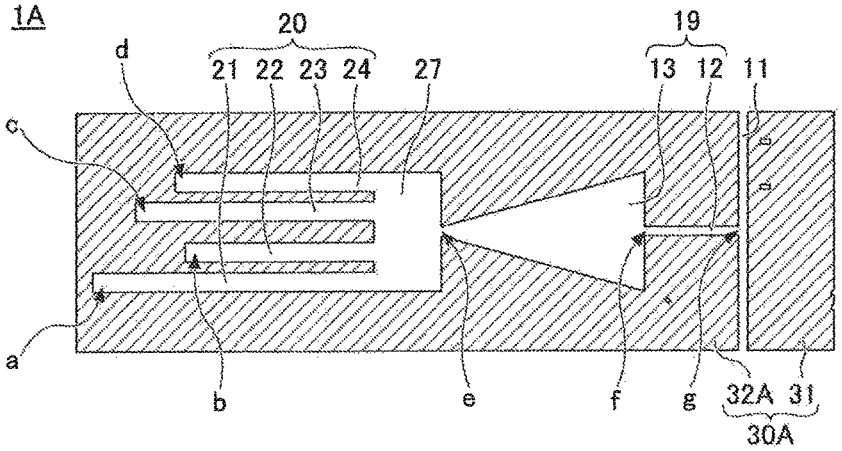
FIG. 6 is an enlarged view depicting a glass antenna according to a second embodiment.

FIG. 6 is an enlarged view depicting a glass antenna 1A according to a second embodiment. In the second embodiment, the two-sided island shaped slots 18 (14, 15) are not arranged.

FIG. 6 illustrates an example of a configuration in which a length in the longitudinal direction is almost the same as the length in the longitudinal direction of the configuration illustrated in FIG. 4. In the second embodiment, in the core wire side conductive body 32A, the island shaped slots 18 (14, 15) on the upper side and the lower side are not arranged, and a length in the longitudinal direction of the space for arranging the glass antenna 1A can be further reduced. Even if a defogger 40 occupies most of the window glass (rear glass) 60 in the up-down direction the glass antenna 1A that is small in the up-down direction can be arranged in a further small margin region of the window glass 60.

In the case of using the antenna according to the second embodiment, because the respective linear slots 21 to 24 of the comb-tooth slot 20 and the connection slot 19 (12,13) extend in an approximately horizontal direction, a vertically polarized wave is sent and received.

However, in the second embodiment, it is impossible to have a minimum value for a return loss at the frequency of 0.7525 GHz where the impedance matching was performed by the island shaped slots 14, 15 in the first embodiment. A return loss in the Band 1 in the first embodiment is more excellent than a return loss in the second embodiment. Thus, it is preferable to select the embodiment appropriately in light of a size of a space for arrangement and performance of the antenna, and to install the antenna.

Third Embodiment

Figure 7A:
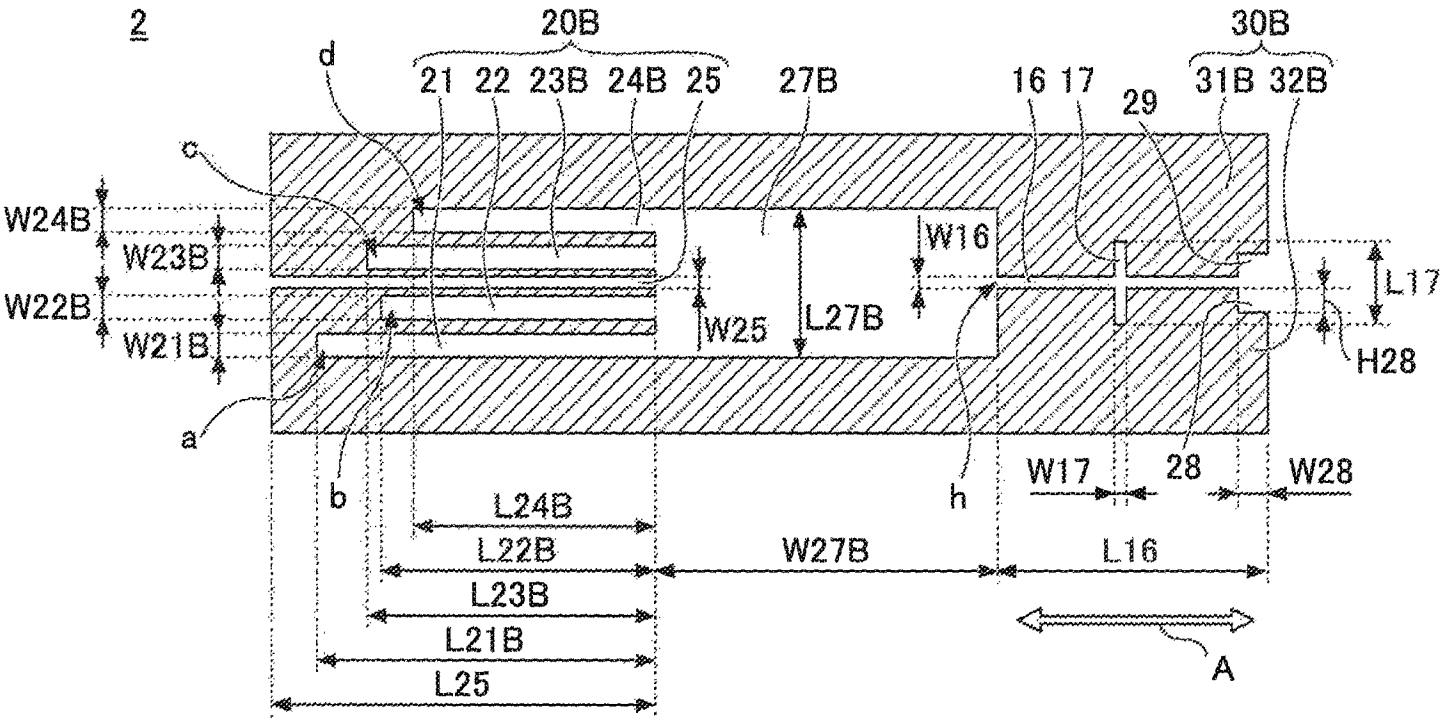
FIG. 7A is an enlarged view depicting a glass antenna according to a third embodiment.

FIG. 7A is an enlarged view depicting a glass antenna 2 according to a third embodiment.

The third embodiment is different from the first and second embodiments in that a power supply slot 16 is directly connected to a root slot 27B, and a first direction where the power supply slot 16 extends is an approximately horizontal direction.

In the third embodiment, the power supply slot 16 extending in an approximately horizontal direction opens in the approximately horizontal direction (right side in FIG. 7A). A linear slot 25, which is one of the slots of the comb-tooth slots 20B and a comb-tooth part connected to the root slot 27B that is a root part, is an open-end slot. One end of the linear slot 25 opens in an approximately horizontal direction (left side in FIG. 7A).

Figure 7B:
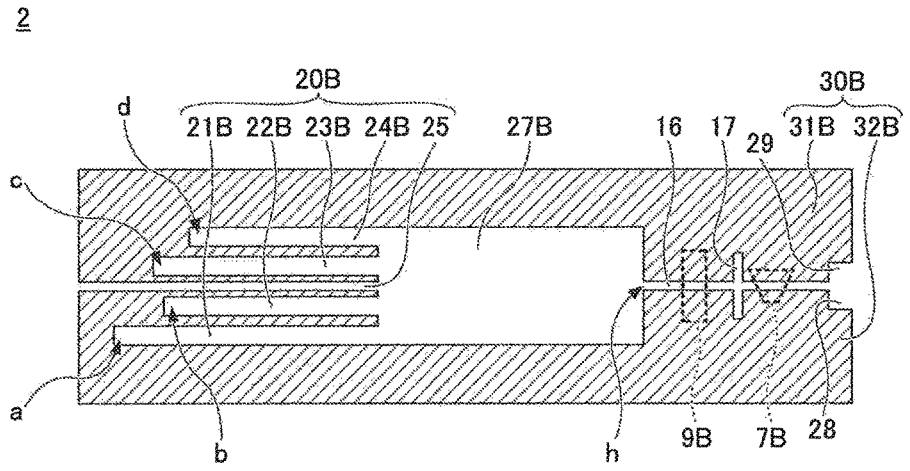
FIG. 7B is an enlarged view depicting an antenna obtained by arranging a resistor and a power supply unit in the communication glass antenna illustrated in FIG. 7A.

FIG. 7B is an enlarged view illustrating a glass antenna obtained by arranging a resistor 9B and a power supply unit 7B in the glass antenna for communication according to the third embodiment illustrated in FIG. 7A.

In the metallic film 30B illustrated in FIG. 7B, a part closer to the lower edge portion 71*c*, where the glass antenna 2 is arranged adjacent to the lower edge portion 71*c*, than the power supply slot 16 (lower part in FIG. 7B) functions as a core wire side conductive body 32B, and a part farther from the lower edge portion 71*c* than the power supply slot 16 functions as a ground side conductive body 31B.

A pair of power supply units 7B are arranged so as to straddle the power supply slot 16. The pair of power supply units 7B supply power to the ground side conductive body 31B and the core wire side conductive body 32B.

In the third embodiment, in the core wire side conductive body 32B, a notch portion 28 is arranged so as to contact the power supply slot 16. Moreover, in the ground side conductive body 31B, a notch portion 29 is arranged so as to contact the power supply slot 16. Note that FIG. 7A and FIG. 7B depict an example where sizes of the notch portions 28 and 29 are the same. The sizes may be different from each other.

By forming the notch portions 28 and 29 in this way, flows of electric currents are controlled, and a resonance frequency can be adjusted.

In the third embodiment, the part near the lower edge portion 71*c* is set to be the core wire side conductive body 32B, and the part far from the lower edge portion 71*c* is set to be the ground side conductive body 31B. Because the sizes of the conductive bodies are almost the same, an opposite assignment is possible. That is, in the third embodiment, an upper part and a lower part of the metallic film 30 function as one of the core wire side conductive body and the ground side conductive body and as the other conductive body, respectively. The function of the conductive body can be appropriately selected according to a direction of arranging the coaxial cable.

In FIG. 7B, the pair consisting of power supply unit 7B and the resistor 9B are arranged adjacent to each other in an approximately horizontal direction. At this time, a division slot 17 extending in a direction approximately orthogonal to the power supply slot 16 extending in the horizontal direction may be arranged between the power supply unit 7B and the resistor 9B so as not to connect the power supply unit 7B and the resistor 9B directly.

In FIG. 7A and FIG. 7B, because the direction where the power supply slot 16 extends is an approximately horizontal direction, the coaxial cable of the power supply unit is arranged in the vertical direction.

Because the arrangement direction of the coaxial cable is set taking into account a shape of a flange of the window to be arranged, locations of arrangement of the other members, and a position of wiring, the embodiment can be appropriately selected according to the arrangement direction of cable.

In the glass antenna 2 according to the third embodiment, because the respective linear slots 21B to 24B of the comb-tooth slot 20B and the power supply slot 16 extend in approximately horizontal directions, a length in the longitudinal direction of the space for arranging the metallic film 30B to be formed can be reduced. Even if a defogger 40 occupies most of the window glass (rear glass) 60 in the up-down direction, the glass antenna 2 that is small in the up-down direction can be arranged in a further small margin region of the window glass 60.

Fourth Embodiment

Figure 8:
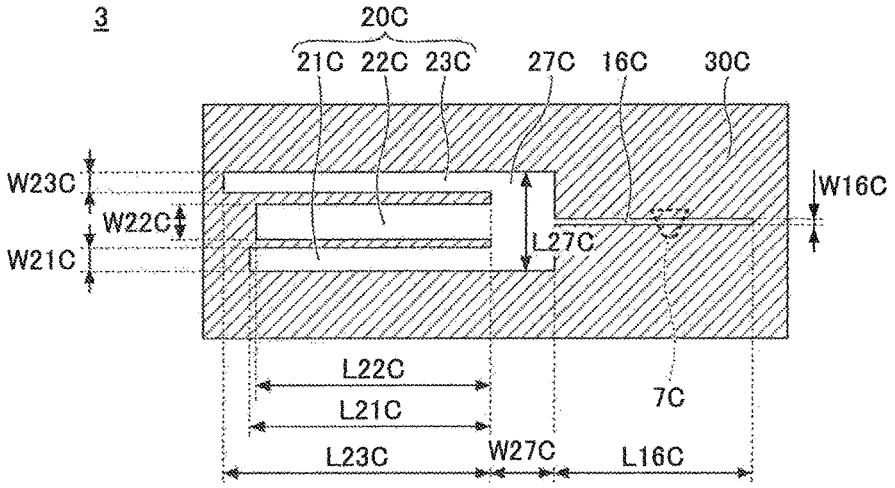
FIG. 8 is an enlarged view depicting a glass antenna according to a fourth embodiment.

FIG. 8 is an enlarged view depicting a glass antenna 3 according to a fourth embodiment.

In the first to third embodiment, the root slot and the comb-tooth slot configured the shape of a head portion of a digging fork. In the tip portion of the head, four comb-tooth slots 20 were arranged, but the number of comb-tooth slots 20C may be three. FIG. 8 illustrates an example in which the comb-tooth slot 20C projected from a root slot 27C and extending in an approximately horizontal direction is provided with three slots 21C, 22C and 23C that are tip portions.

In the fourth embodiment, in the same way as in the third embodiment, a power supply slot 16C and the root slot 27C are directly connected to each other, and a first direction where the power supply slot 16C extends is an approximately horizontal direction.

In the embodiment including three comb-tooth slots, in the case of obtaining a desired antenna performance in a desired frequency band used for a communication wave, slot widths of the slots 21C, 22C and 23C that are tip portions having linear shapes are greater than the slot widths of the slots 21, 22, 23 and 24 in the first to third embodiments, and length of the slots 21C, 22C and 23C are shorter than those of the slots 21, 22, 23 and 24.

The fourth embodiment can be applied to the case where there is enough space for arranging the antenna both in the vertical direction and in the horizontal direction.

In the fourth embodiment, because an opening portion is not formed in a metallic film 30C, a cutout portion does not contact an edge portion of the metallic film 30C, and an electric field generated by an electric current inside the metallic film 30C forming slots is formed in a closed loop. The glass antenna 3 is not likely to be affected by an interference with a metal around the glass antenna 3. It becomes possible to make the distance from the edge portions 71*c*, 71*b* of the vehicle chassis 70 to the glass antenna 3 according to the embodiment further smaller. Because the size of space for arranging the antenna and the distance from the vehicle chassis vary depending on vehicles, the configuration is appropriately selected.

Even in the case of employing the third embodiment or the fourth embodiment, because the respective linear slots 21 to 24 (21C to 23C) of the comb-tooth slot 20 (20C) and the power supply slot 16 (16C) extend in an approximately horizontal direction, vertically polarized waves can be transmitted/received. It becomes easy to transmit/receive radio waves of vertically polarized communication waves.

In the first embodiment or the second embodiment, the power supply unit 7 is arranged in the lower part of the metallic film 30. In the case where a rear support part (interior material) of a backseat banks upward, at the stage of assembling the vehicle, it is difficult to arrange a connector in the lower part inside the conductive film.

Moreover, in this way, in the case where the rear support part is arranged in proximity to the rear glass, and a metallic part of the rear support part is projected from the lower edge portion 71*c* of the opening of the body 70, the power supply unit 7 is more affected from the metallic part of the rear support part than from the lower edge portion 71*c*.

From the viewpoint of assembly and from the viewpoint of avoiding an influence from the metallic portion of the rear support part, as an antenna corresponding to the interior material of the vehicle, a configuration of arranging a connector in an upper part inside the conductive film is preferable. As an example of arranging the power supply unit in the upper part inside the conductive film, a fifth embodiment and a sixth embodiment will be described in the following.

Fifth Embodiment

Figure 9A:
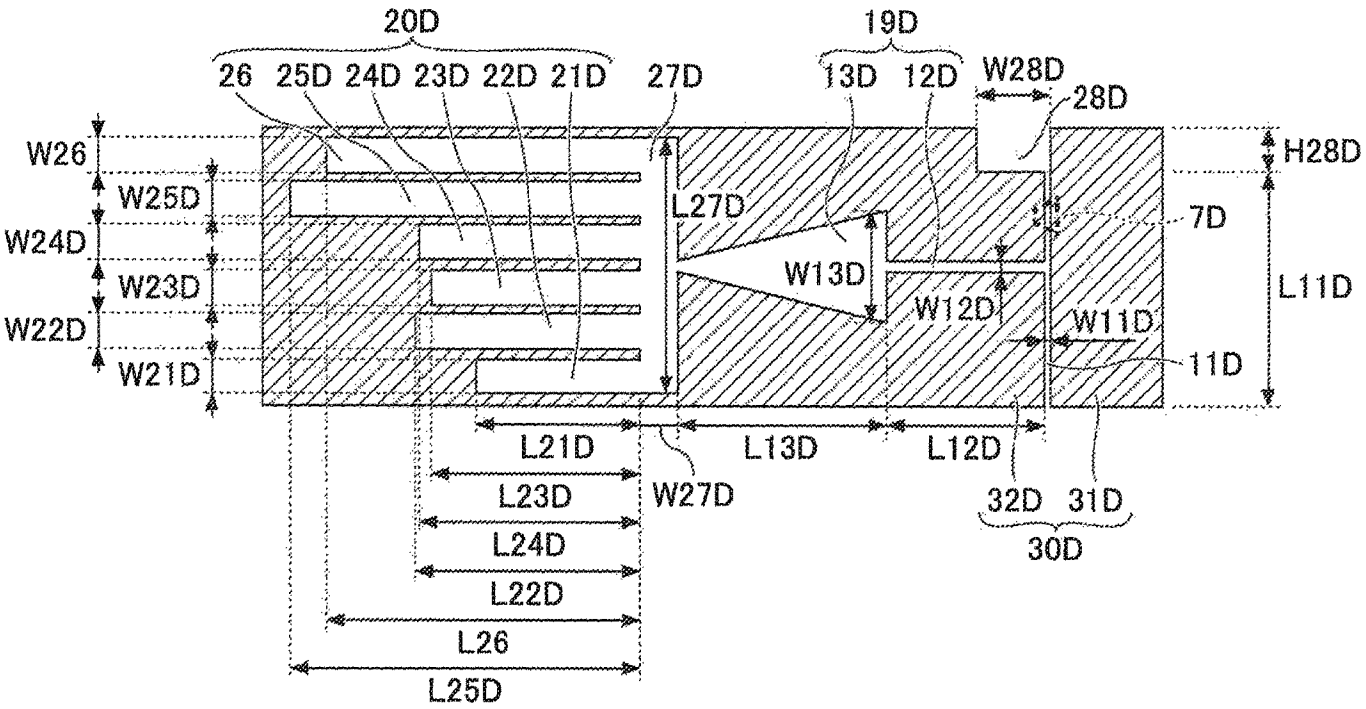
FIG. 9A is an enlarged view depicting a glass antenna according to a fifth embodiment.

FIG. 9A is an enlarged view depicting a glass antenna 4 according to a fifth embodiment. The glass antenna 4 according to the fifth embodiment is different from the glass antenna 1A according to the second embodiment illustrated in FIG. 6 in that the comb-tooth slot is provided with six linear slots, a part of the core wire side conductive body 32D is cutout and the position of the power supply unit 7D is different.

In the fifth embodiment, the comb-tooth slot 20D is provided with a first slot 21D, a second slot 22D, a third slot 23D, a fourth slot 24D, a fifth slot 25D and a sixth slot 26 that are tip portions having linear shapes. Slot lengths of the first slot 21D, the second slot 22D, the third slot 23D, the fourth slot 24D, the fifth slot 25D and the sixth slot 26 are different from each other.

As illustrated in FIG. 9A, the slot lengths of the six linear slots are different from each other. Furthermore, a greater number of linear slots are arranged than the first embodiment, i.e. four linear slots. Because the number of slots extending in an approximately horizontal direction is great, with respect to important vertically polarized waves, an excellent broadband communication can be performed without arranging island shaped slots.

Figure 9B:
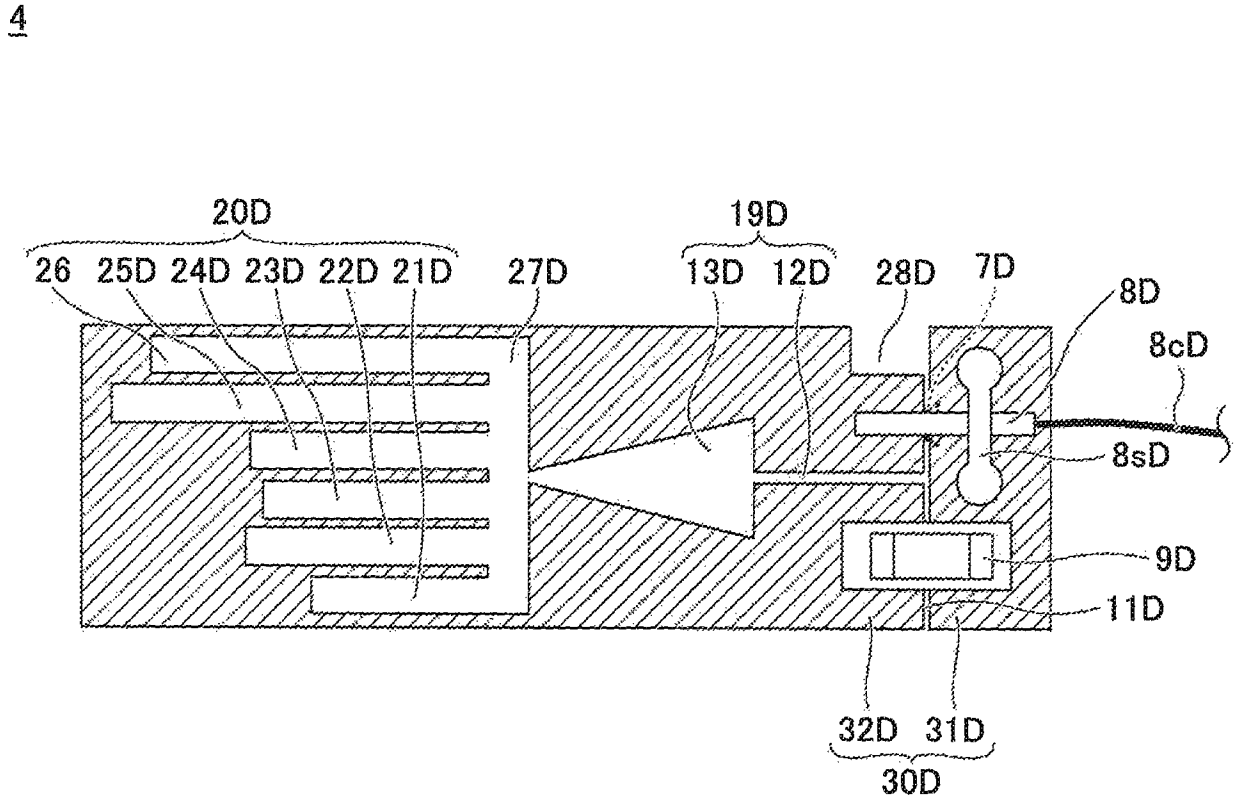
FIG. 9B is an enlarged view depicting an antenna obtained by arranging a resistor and a power supply unit in the glass antenna illustrated in FIG. 9A.

FIG. 9B is an enlarged view depicting a glass antenna obtained by arranging a resistor 9D, and arranging a connector 8D connected to a coaxial cable 8*c*D at the power supply unit 7 on the glass antenna 4 illustrated in FIG. 9A.

In the metallic film 30D, in the same way as in FIG. 5, a part closer to the side edge portion 71B of the vehicle chassis 70, where the glass antenna 4 is arranged adjacent to the side edge portion 71B, than the power supply slot 11D (right part in FIG. 9B) functions as a ground side conductive body 31D, and a part farther from the side edge portion 71*b* than the power supply slot 11D (left part in FIG. 9B) functions as a core wire side conductive body 32D.

Moreover, in the configuration illustrated in FIG. 9B, different from the configurations of the first and second embodiments, the power supply unit 7D, to which the connector 8D is soldered with a solder 8*s*D, is located above a part at which the linear connection slot 12D is connected to the power supply slot 11D.

In the core wire side conductive body 32D, a notch portion 28D is arranged so as to contact the power supply slot 11D. As illustrated in FIG. 9B, in the same way as in FIG. 5, the resistor 9D is arranged and the connector 8D connected to the coaxial cable 8*c*D is arranged at the power supply unit 7D in the glass antenna 4.

Because a part in which the resistor 9D is arranged is required to have a wide conductor area, a notch portion 28D is close to a site, at which the coaxial cable 8*c*D is arranged (power supply unit 7D), and is cut from up above the power supply slot 11D extending in an approximately vertical direction, so as not to be connected to the linear connection slot 12D. By forming the notch portion 28D in this way, it becomes possible to control a flow of an electric current and to adjust a resonance frequency.

In addition, although in the examples illustrated in FIG. 9A and FIG. 9B, the notch portion 28D is cut from up above, the notch portion 28D need not include an upper edge of the core wire side conductive body 32D, as long as the notch portion 28D is connected to the power supply slot 11D. For example, the notch portion may be formed leaving the upper edge of the core wire side conductive body 32D as a linear element.

Because the vehicle is a movable body, the vehicle is preferably provided with a plurality of communication antennas and is able to select a radio wave by switching to an antenna with higher receiving sensitivity depending on a location. Alternatively, a MIMO (Multiple-Input Multiple-Output) configuration that increases a communication capacity by a plurality of antennas is further preferable.

In the present invention, a wide band antenna having the same configuration as the antenna 1 according to the embodiment may additionally be arranged at a position approximately symmetric to the antenna 1 with respect to a center line extending in the width direction of the window glass 60. At this time, in order to avoid interference with each other, the plurality of antennas are preferably arranged separated by a predetermined distance (e.g. greater than or equal to 0.2 times a wavelength of an electric wave with a frequency of 0.7 GHz, i.e. 86 mm). In this way, by arranging a plurality of glass antennas on the window glass 60 so that the communication performance is enhanced by switching antennas, or by providing the MIMO configuration, also in the vehicle that is a movable body, the effect of improving the communication capacity in a wide band can be obtained.

For example, in order to further improve the communication capacity or for other use, in parts near the right and left corner portions of the opening of the window glass 60, illustrated in FIG. 3, as the MIMO configuration, two glass antennas 1 having a left-right symmetric configuration may be arranged. Alternatively, two antennas may be arranged combining with the antenna according to the other embodiment.

In the following, in a sixth embodiment, a configuration of a glass antenna, which is preferably used combining with the glass antenna according to any one of the first to fifth embodiments, on the premise that the glass antenna is arranged at the lower left position indicated by a dotted line in FIG. 3 for the purpose of improving the reception condition in the ISM frequency band, will be described.

Sixth Embodiment

Figure 10A:
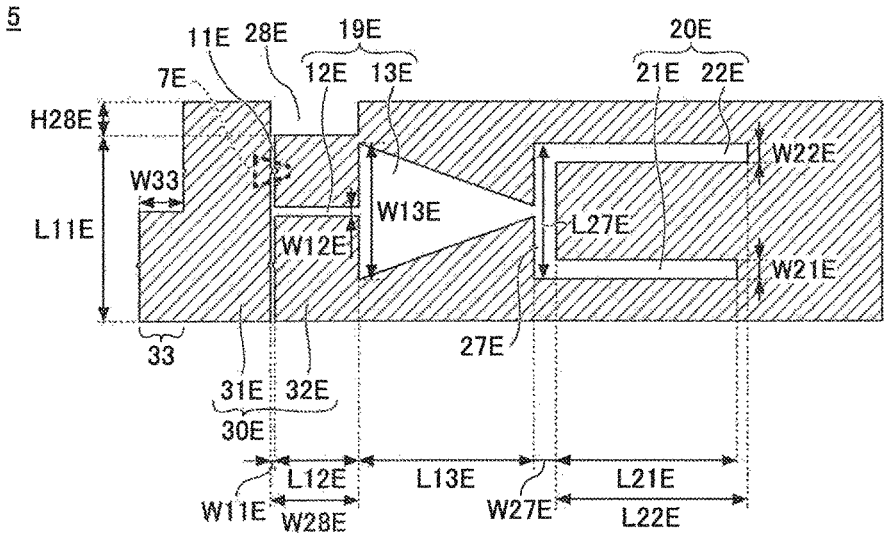
FIG. 10A is an enlarged view depicting a glass antenna according to a sixth embodiment.

FIG. 10A is an enlarged view depicting a glass antenna 5 according to the sixth embodiment. The glass antenna according to the sixth embodiment is different from the glass antenna 1A according to the second embodiment illustrated in FIG. 6, in that two linear slots are arranged in the comb-tooth slot 20E, a part of the ground side conductive body 31E is extended, and a position of the power supply unit 7E is different.

In the embodiment, the comb-tooth slot 20E is provided with a first slot 21E and a second slot 22E both having a linear shape. An end portion of the first slot 21E is connected to a lower end of the root slot 27E that extends in an approximately vertical direction, and an end portion of the second slot 22E is connected to an upper end of the root slot 27E. In the embodiment, the comb-tooth slot 20E is not provided with a central part comb-tooth slot. The first slot 21E is a lower part comb-tooth slot and the second slot 22E is an upper part comb-tooth slot.

As illustrated in FIG. 10A, slot lengths of two linear slots 21E, 22E arranged in an upper part and a lower part, respectively, are different from each other. The glass antenna according to the embodiment is intended to transmit/receive ISM electric waves within a band that is narrower than for the LTE, and the ISM band can be covered precisely. The feature will be described later in detail (in Example 8).

Figure 10B:
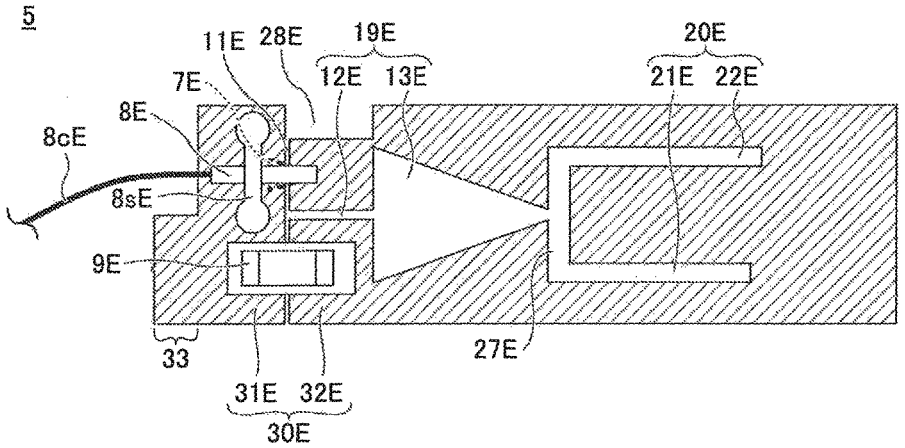
FIG. 10B is an enlarged view depicting an antenna obtained by arranging a resistor and a power supply unit in the glass antenna illustrated in FIG. 10A.

FIG. 10B is an enlarged view depicting an antenna obtained by arranging a resistor 9E, a connector 8E connected to a coaxial cable 8*c*E at a power supply unit 7E with respect to the glass antenna 5 illustrated in FIG. 10A.

In the metallic film 30E, different from FIG. 9B, a part farther than the side edge portion 71*b* of the vehicle chassis 70, which is arranged adjacent to the glass antenna 5, than the power supply slot 11 (right side in FIG. 10B) functions as a ground side conductive body 31E, and a part (left side) closer to the side edge portion 71*b* than the power supply slot 11 functions as a core wire side conductive body 32E.

In the configuration illustrated in FIG. 10B, different from the configuration illustrated in FIG. 9B, the power supply unit 7E, to which the connector 8E is soldered with a solder 8*s*E, is located above a part at which the linear connection slot 12E is connected to the power supply slot 11E.

With respect to the ground side conductive body 31E, a part in which the resistor 9E is arranged is formed to be greater than the other parts. That is, an extension part 33 is arranged.

Because a part in which the resistor 9E is arranged is required to have a wide conductor area, the ground side conductive body 31E has a shape in which the part in which the resistor 9E is arranged is extended to be greater than a portion in which the connector 8E is arranged that is another region. In this way, by arranging the extension part 33, it becomes possible to adjust a resonance frequency while controlling interference from the resistor 9E.

Note that FIGS. 10A and 10B illustrate an example in which the extension part 33 is arranged in an approximately lower half of the ground side conductive body. However, in the extension part 33, the part in which the resistor 9E is arranged may be extended only partially. For example, on a lower edge of the ground side conductive body 31E, the ground side conductive body 31E may not be expanded, and only a part around the part in which the resistor 9E is arranged may project.

In the sixth embodiment, the antenna that receives an electric wave in the ISM band has been described. An antenna for another use may be arranged on the rear glass.

For example, in FIG. 3, an antenna for a different use than the antenna according to the embodiment, i.e. other than LTE, ISM, for example an antenna for receiving broadcasting waves (TV, AM, FM, DTV, DAB, or the like) may be arranged on the rear glass. Alternatively, an antenna for remote keyless entry or an antenna for smart entry that locks and unlocks vehicle doors may be arranged on the rear glass.

As described above, in the case where a glass antenna for different use from the glass antenna according to the present invention is arranged on the rear glass, the glass antenna for different use is preferably arranged at a location separated from the glass antenna according to the present invention on the window glass. For example, in the case illustrated in FIG. 3, the glass antenna for different use is preferably arranged near the upper edge portion. In the case where the antenna according to the present invention is arranged near the upper edge portion, the antenna for different use is preferably arranged near the lower edge portion.

Moreover, in the embodiment described above, the glass antenna is configured by arranging on the window glass (rear glass) 60 for vehicle a metallic film (conductive film) that is a conductive body (e.g. a copper foil or a silver foil) in which the cutout portion 10 is formed by punching or etching. Furthermore, the glass antenna according to the present invention can be configured by printing using a screen plate in the same way as a conventional glass antenna or a defogger that is formed by burning a silver paste. In this case, the glass antenna according to the present invention can be formed collectively with another glass antenna or a defogger, and is excellent in mass productivity.

However, the glass antenna may be formed by arranging (attaching), at a predetermined location on a vehicle interior surface or a vehicle exterior surface of a window glass, a synthetic resin film, a flexible circuit substrate or the like in which or on which a conductive layer including the above-described cutout portion is arranged.

Moreover, in order to control against a rise in temperature in vehicle or to counteract ultraviolet rays, there is a window that is coated with a metallic layer of a thin film having a low UV transmittance and reflecting IR ray of sunlight. In this case, the above-described cutout portion may be formed in a part of the thin film of the metallic layer so that the metallic layer functions as a glass antenna.

As described above, the glass antenna and the window glass have been described by the plurality of embodiments. The present invention is not limited to the embodiments. Various variations and improvements, such as combination/replacement with/by a part or a whole of another embodiment may be made without departing from the scope of the present invention.

EXAMPLE

First Example

<Electric Current Simulation According to the First Embodiment>

Figure 11:
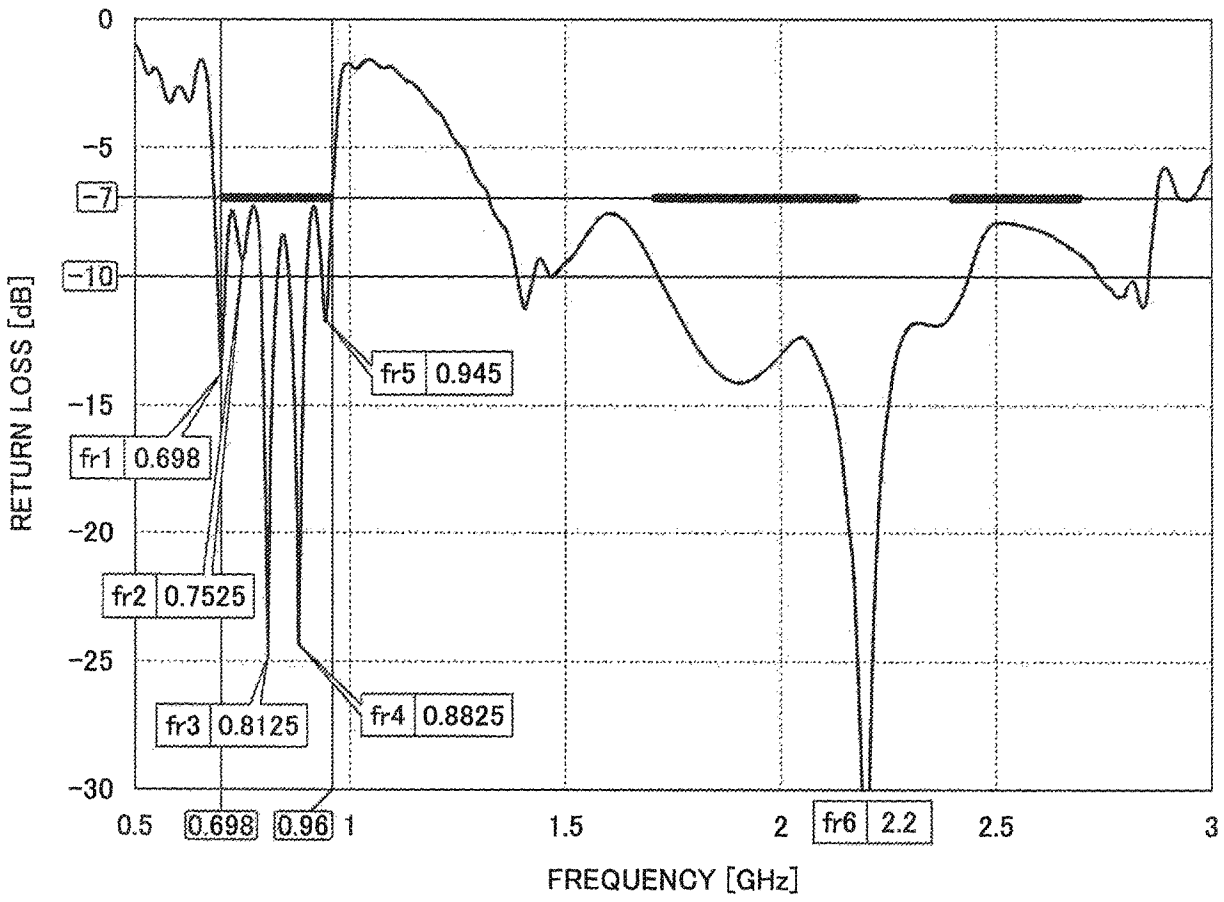
FIG. 11 is a diagram depicting a graph showing a return loss including a minimum value obtained by a simulation for the glass antenna according to the first embodiment illustrated in FIG. 5.

FIG. 11 is a diagram depicting a graph showing a return loss including a minimum value obtained by a simulation for the glass antenna according to the first embodiment. In addition, FIG. 11 depicts an example of a graph obtained by performing a simulation for a glass antenna 1 arranged on a simple glass that is the same as the rear glass, separately from the vehicle.

As described later, by an electromagnetic field simulation based on the FI (Finite Integration) method, for the glass antenna according to the embodiment, with parameter values set as described later, a return loss (reflection coefficient) was numerically calculated for a frequency within a range of 0.5 GHz to 3.0 GHz.

Typically, within a frequency band used for communication, the return loss is preferably −7 dB or less, and more preferably −10 dB or less.

In the shape of the glass antenna 1 illustrated in FIG. 4, dimensions were as follows (in units of mm):

L11 (slot length) 50,
W11, W12 (slot width): 2,
W14, W15 (slot width): 3.5,
L12: 20,
L13: 42.8
W13 (base length of triangle of triangle shaped slot): 25,
L14, L15: 114,
L27: 25.0,
W27: 14.3,
L21: 59.5,
L22: 39.7;
L23: 50.4;
L24: 41.8,
W21, W22, W23, W24: 4,
Horizontal length of the ground side conductive body 31: 18,
Vertical length of the metallic film 30: 50, and
Horizontal length of the metallic film 30: 160.

Moreover, the power supply unit 7 (connector 8) was arranged in the power supply slot 11 near almost a center between a lower end of the power supply slot 11 and a connection point g where the power supply slot 11 is connected to the linear connection slot 12. The resistor 9 was arranged in the power supply slot near almost a center between an upper end of the power supply slot and the connection point g.

As can be seen from FIG. 11, the glass antenna 1 according to the present invention is set to have a minimum value (bottom value) for a specific frequency in the frequency band used for communication.

A distribution of an electric current in the metallic film 30 by a simulation will be described for the respective frequency bands with reference to FIGS. 12 to 20. In the embodiment of the present invention, a frequency band within a range from 0.698 GHz to 0.96 GHz will be referred to as Band 1, a frequency band within a range from 1.71 GHz to 2.17 GHz will be referred to as Band 2, and a frequency band within a range from 2.4 GHz to 2.69 GHz will be referred to as Band 3.

Figure 12:
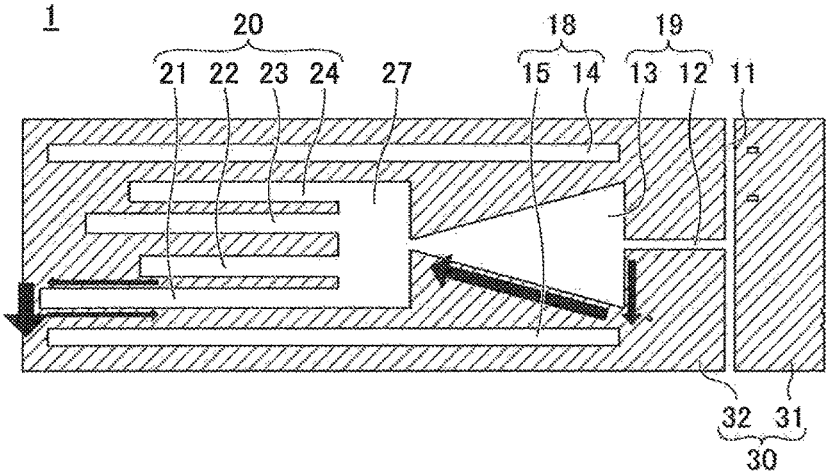
FIG. 12 is a diagram schematically depicting an electric current distribution in the case where the return loss has a minimum value at a frequency of 0.698 GHz.

FIG. 12 is a diagram schematically illustrating an electric current distribution in the case where the return loss has a minimum value at a frequency of 0.698 GHz. When the frequency is 0.698 GHz, the first slot 21, which is the longest slot and arranged at the lowest portion in the comb-tooth slot 20, resonates, and thereby an electric current flows in a periphery of the first slot 21 and in a lower periphery of the triangular slot 13, to radiate an electro-magnetic field.

Figure 13:
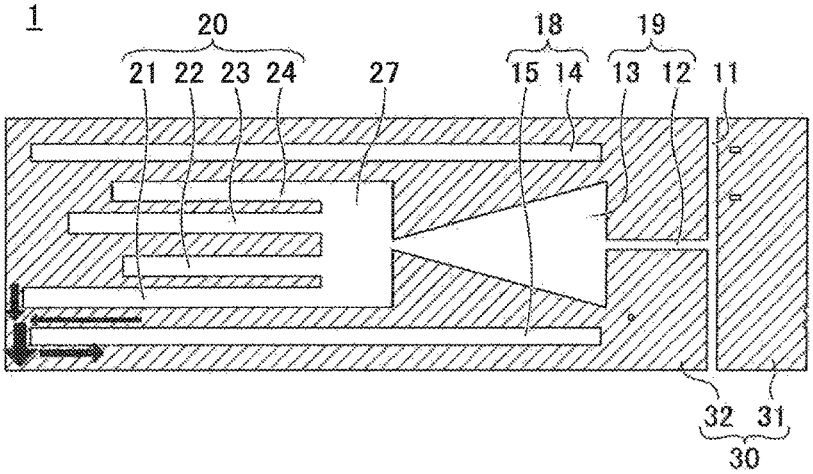
FIG. 13 is a diagram schematically depicting an electric current distribution in the case where the return loss has a minimum value at a frequency of 0.7525 GHz.

FIG. 13 is a diagram schematically illustrating an electric current distribution in the case where the return loss has a minimum value at a frequency of 0.7525 GHz. When the frequency is 0.7525 GHz, the lower island shaped slot 15 resonates, and thereby an electric current flows in a periphery of the island shaped slot 15, to radiate an electro-magnetic field.

Figure 14:
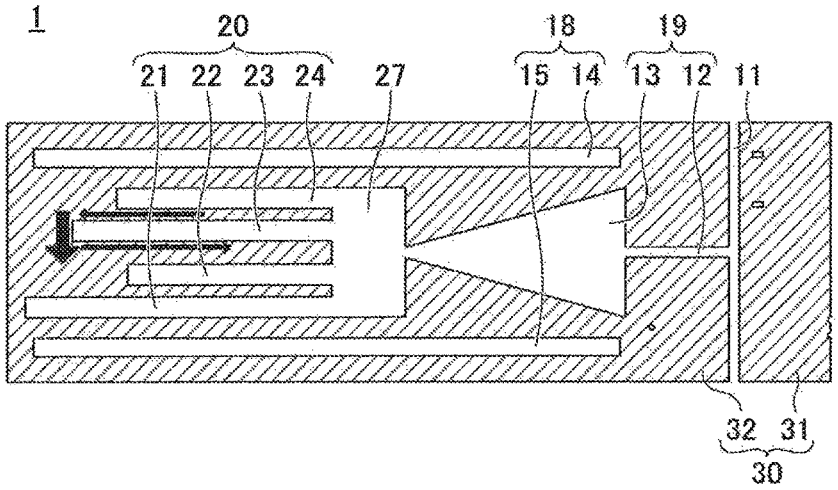
FIG. 14 is a diagram schematically depicting an electric current distribution in the case where the return loss has a minimum value at a frequency of 0.8125 GHz.

FIG. 14 is a diagram schematically illustrating an electric current distribution in the case where the return loss has a minimum value at a frequency of 0.8125 GHz. When the frequency is 0.8125 GHz, the third slot 23, which is the second longest slot and arranged at around a center in the comb-tooth slot 20, resonates, and thereby an electric current flows in a periphery of the third slot 23, to radiate an electro-magnetic field.

Figure 15:
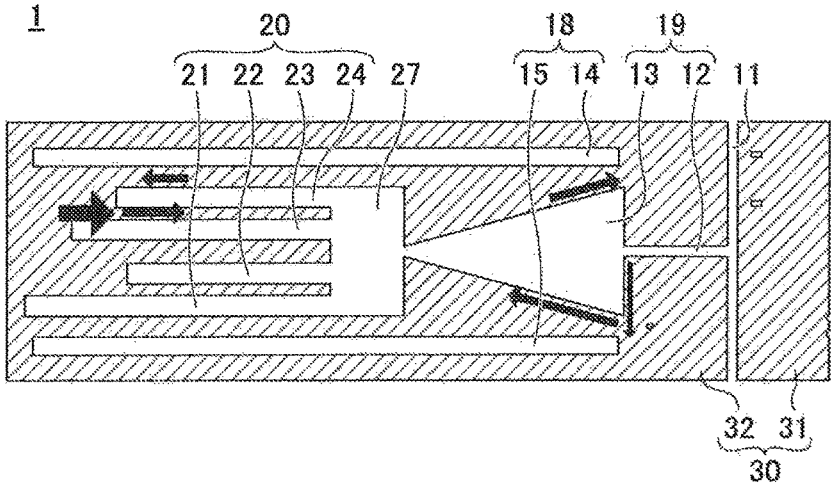
FIG. 15 is a diagram schematically depicting an electric current distribution in the case where the return loss has a minimum value at a frequency of 0.8825 GHz.

FIG. 15 is a diagram schematically illustrating an electric current distribution in the case where the return loss has a minimum value at a frequency of 0.8825 GHz. When the frequency is 0.8825 GHz, the fourth slot 24, which is the third longest slot and arranged at the highest portion in the comb-tooth slot 20, resonates, and thereby an electric current flows in a periphery of the fourth slot 24 and in a lower periphery and an upper periphery of the triangular slot 13, to radiate an electro-magnetic field.

Figure 16:
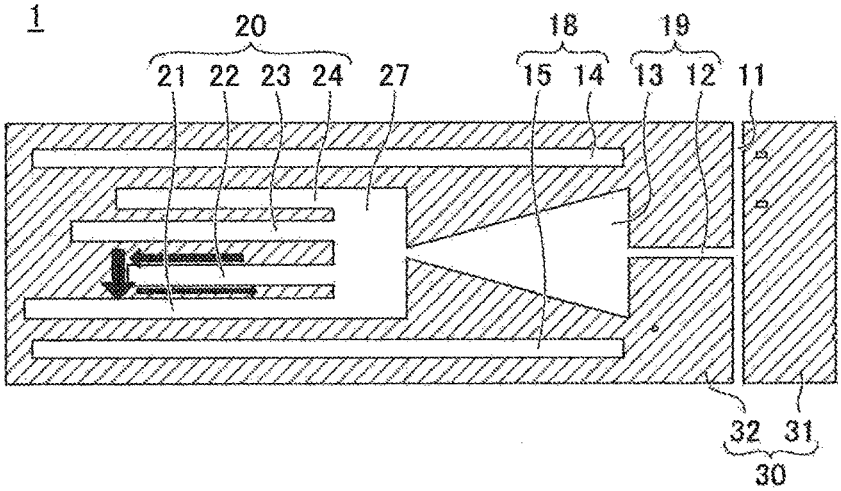
FIG. 16 is a diagram schematically depicting an electric current distribution in the case where the frequency is 0.945 GHz and 0.96 GHz.

FIG. 16 is a diagram schematically illustrating an electric current distribution in the case where the frequency is 0.945 GHz and 0.96 GHz. When the frequency is 0.945 GHz, the second slot 22, which is the shortest slot and arranged at around the center in the comb-tooth slot 20, resonates, and thereby an electric current flows in a periphery of the second slot 22, to radiate an electro-magnetic field.

As can be seen from FIGS. 12 to 16, in the Band 1 (0.698 GHz to 0.96 GHz), in the comb-tooth slot 20 forming a tip section of a head portion of a fork, when the slot becomes longer, the resonance frequency shifts to the lower frequency side. When the slot becomes shorter, the resonance frequency shifts to the higher frequency side.

In addition, when the first slot 21 that is located in the lowest portion or the fourth slot 24 that is located in the highest portion, resonates, an electric current also flows in a periphery of the triangular slot 13.

Assuming that a wavelength of an electric wave in the air at a central frequency in the frequency band is X, a wavelength contraction rate is k, and a wavelength of an electric wave propagating in the glass is λq, i.e. λg=λ·k, at the predetermined four frequencies in the frequency band, Band 1 (in the above example, 0.698 GHz, 0.8125 GHz, 0.8825 GHz and 0.945 GHz), slot lengths of the first slot 21, the second slot 22, the third slot 23 and the fourth slot 24 are set to fall within a range of ⅙λq to ⅓λq, and thereby an impedance matching can be performed.

Moreover, similarly, a slot length of the island shaped slot 15 is set to fall within a range of 0.4λq to 0.6λq at a predetermined single frequency in the frequency band of Band 1 (in the above example, 0.7525 GHz), and thereby an impedance matching can be performed.

Figure 17:
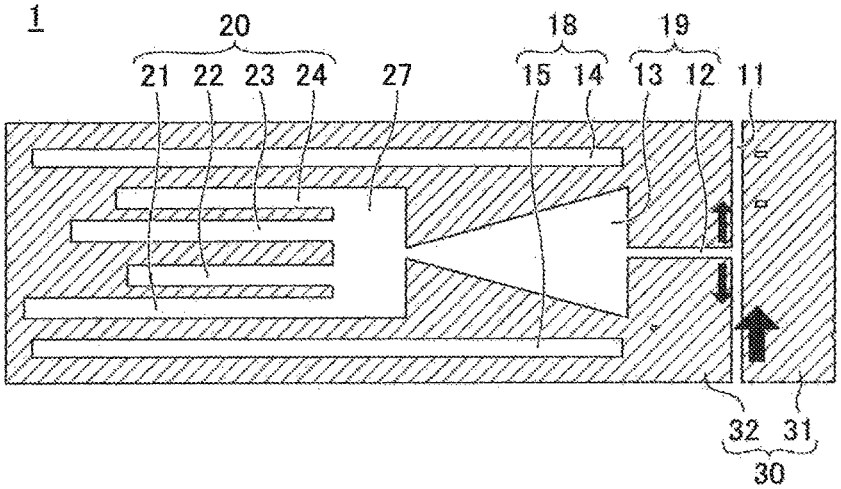
FIG. 17 is a diagram schematically depicting an electric current distribution in the case where the frequency is 1.71 GHz.

FIG. 17 is a diagram schematically depicting an electric current distribution in the case where the frequency is 1.71 GHz (Band 2). When the frequency is 1.71 GHz, an electric current flows in the power supply slot 11, to radiate an electro-magnetic field.

Figure 18:
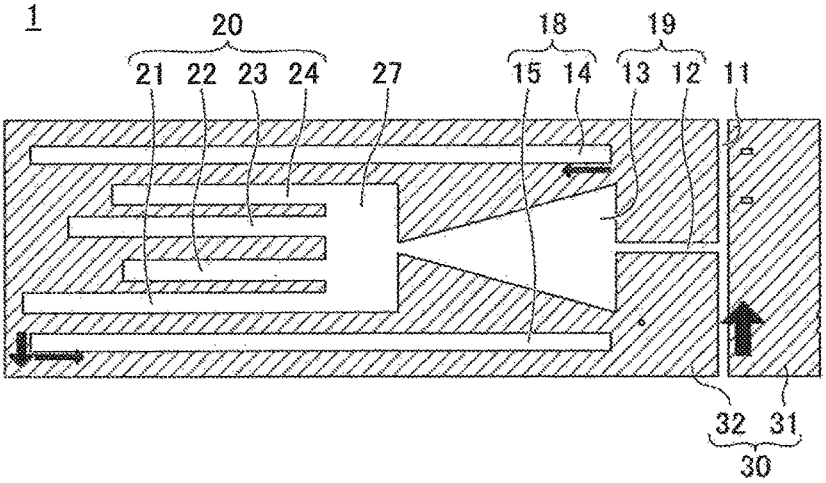
FIG. 18 is a diagram schematically depicting an electric current distribution in the case where the frequency is 2.17 GHz.

FIG. 18 is a diagram schematically depicting an electric current distribution in the case where the frequency is 2.17 GHz (Band 2). When the frequency is 2.17 GHz, a great electric current flows in the power supply slot 11, and small electric currents flow in the upper and lower island shaped slots 14, 15, to radiate an electro-magnetic field.

Figure 19:
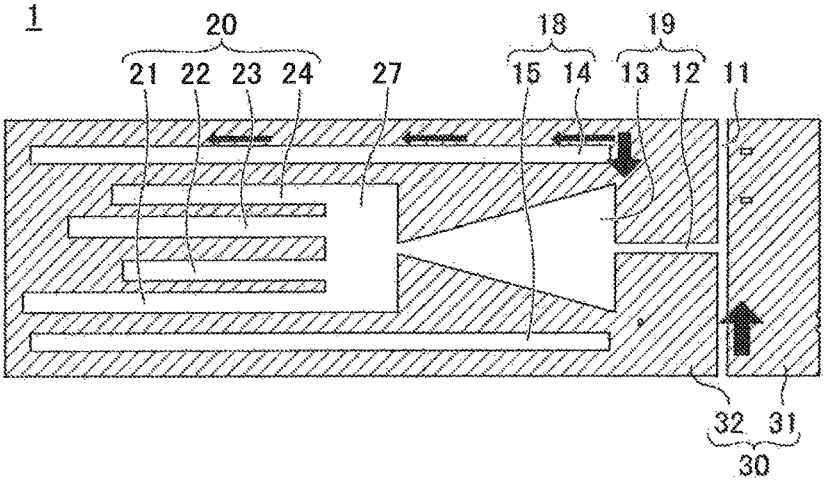
FIG. 19 is a diagram schematically depicting an electric current distribution in the case where the return loss has a minimum value at a frequency of 2.2 GHz.

FIG. 19 is a diagram schematically illustrating an electric current distribution in the case where the return loss has a minimum value at a frequency of 2.2 GHz. When the frequency is 2.2 GHz, a great electric current flows in the power supply slot 11, and an electric current flows in the upper island shaped slot 14, to radiate an electro-magnetic field. Note that this frequency is excluded from the desired frequency band according to the present invention.

Figure 20:
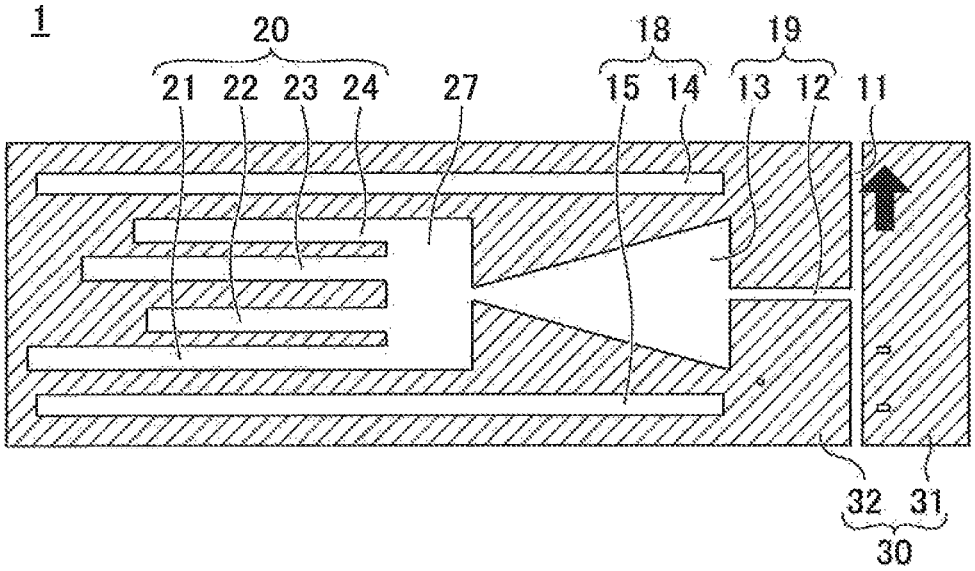
FIG. 20 is a diagram schematically depicting an electric current distribution in the case where the frequency is 2.4 GHz and 2.69 GHz.

FIG. 20 is a diagram schematically depicting an electric current distribution in the case where the frequency is 2.4 GHz and 2.69 GHz (Band 3). When the frequency is in Band 3, a great electric current flows in the power supply slot 11, to radiate an electro-magnetic field.

As can be seen from the electric current distribution diagrams by simulation illustrated in FIGS. 12 to 20, a plurality of slots with different length and different widths are formed in the glass antenna 1 according to the embodiment, and the glass antenna 1 can correspond to a wide frequency band.

Second Example

<Return Loss when Attachment Position of Power Supply Unit Changes According to First Embodiment>

For the glass antenna 1 according to the first embodiment illustrated in FIG. 4 having the dimensions described below, assuming the configuration being attached to a glass plate representing the window glass 60, a simulation was performed for the return loss when the position where the power supply unit 7 is arranged is changed.

The dimensions of the glass antenna according to Second Example are set to be the same as in First Example.

Figure 21:
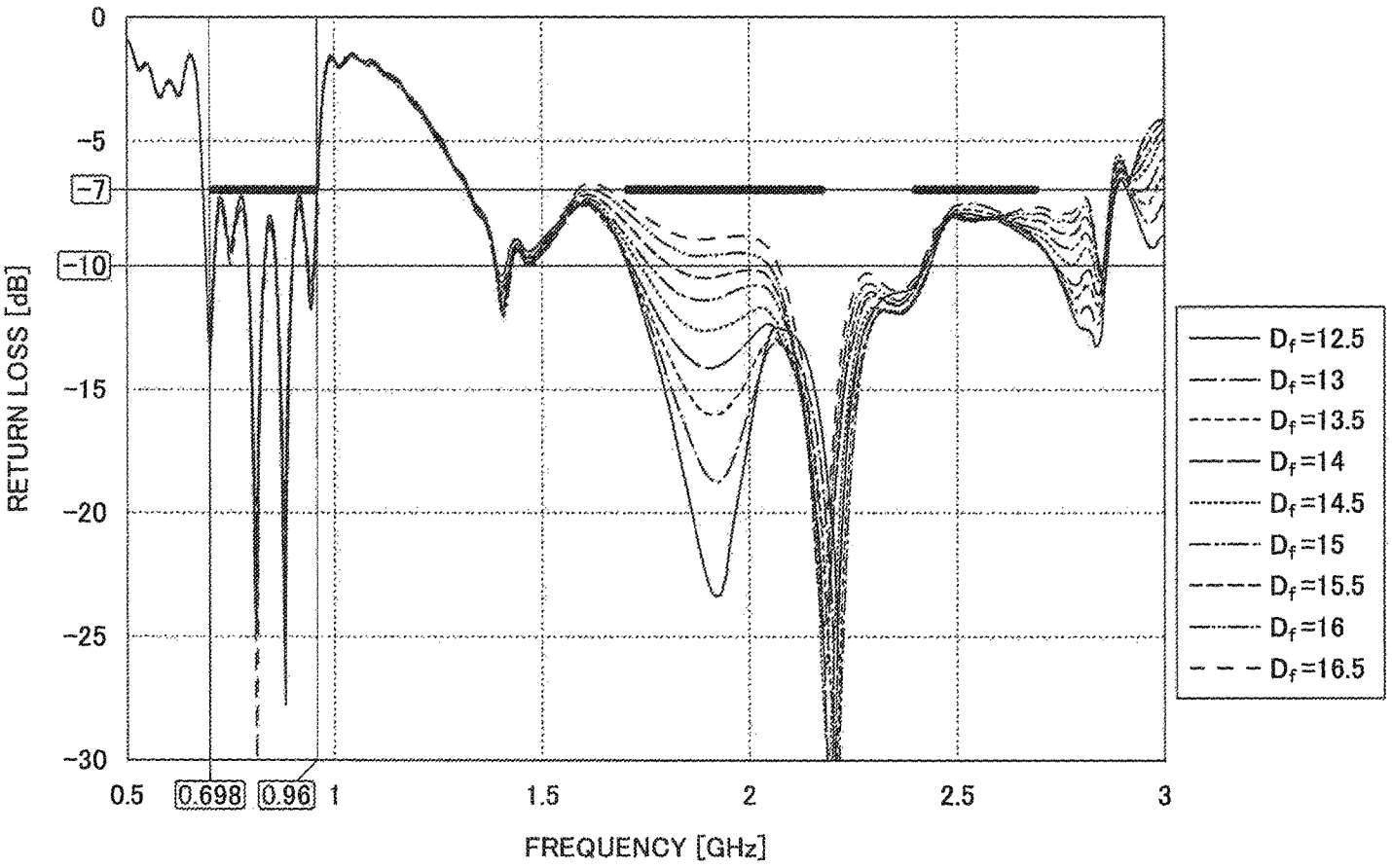
FIG. 21 is a diagram depicting a graph showing a return loss in the case where an arrangement position of the power supply unit is changed in the glass antenna according to the first embodiment.

FIG. 21 is a diagram depicting a graph showing a return loss (results of simulation) in the case where the arrangement position of the power supply unit 7 is changed in the glass antenna according to the first embodiment, illustrated in FIG. 4, in the frequency band used for communication.

In FIG. 21, $D_f$ represents a position of the power supply unit 7, where the center of the metallic film 30 in the vertical direction is set to 0 mm (located 25 mm from the outer edge). In the second example, the value of $D_f$ varies, i.e. 12.5 mm, 13 mm, 13.5 mm, 14 mm, 14.5 mm, 15 mm, 15.5 mm, 16 mm and 16.5 mm.

As shown in FIG. 21, even if the position of the power supply unit 7 varies, in the desired frequency bands, i.e. Band 1 to Band 3, the return loss is less than or equal to −7 dB. The performance of the antenna is maintained.

In the manufacturing process, even if the position of the power supply unit 7 deviates from the power supply position of the design value ($D_f$ is 14.5 mm), the performance is maintained. Thus, the robustness for position can be enhanced.

Third Example

<Return Loss Estimated by Simulation According to Third Embodiment>

Figure 23:
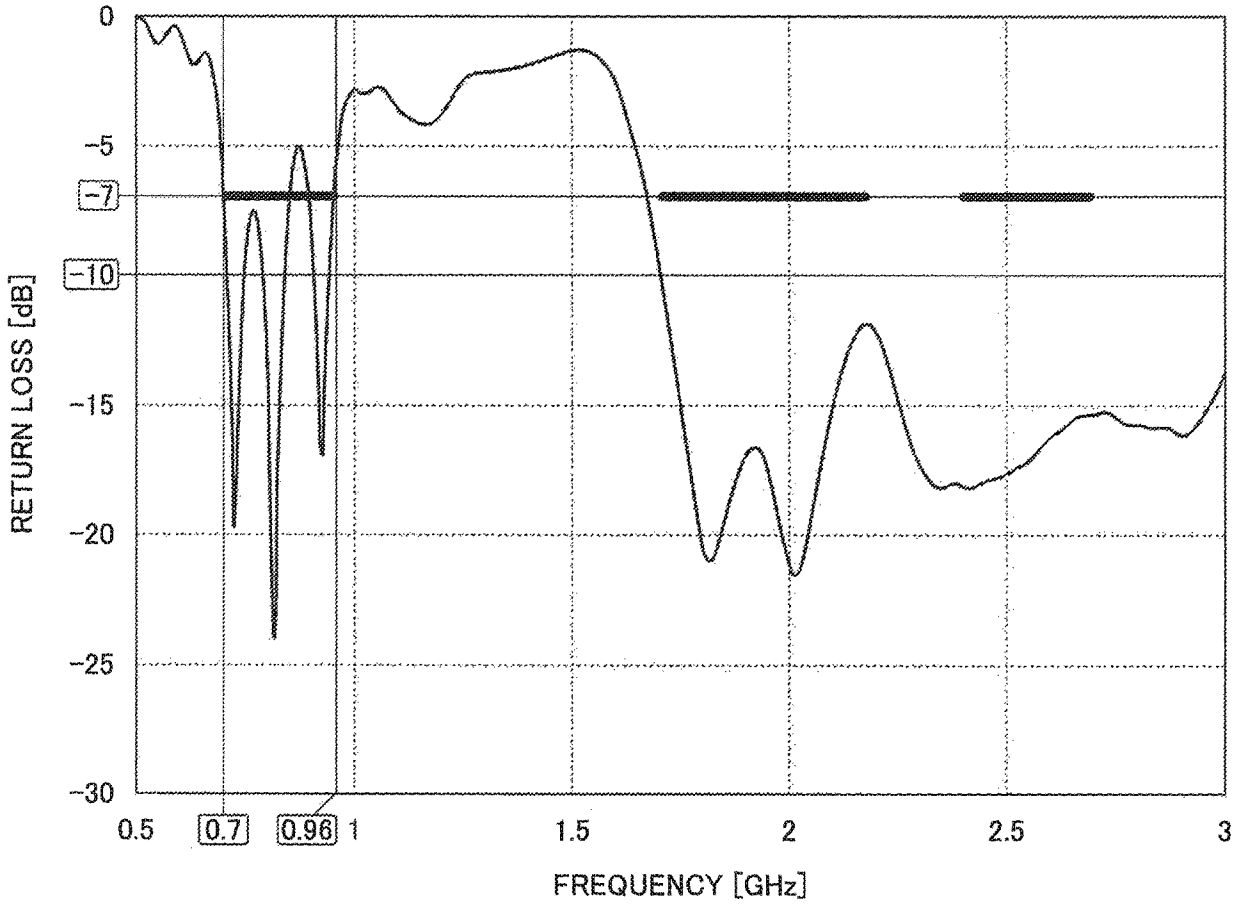
FIG. 23 is a diagram depicting a graph showing a return loss obtained by a simulation for the glass antenna according to the third embodiment.

FIG. 23 is a diagram depicting a graph showing a return loss in the glass antenna 2 according to the third embodiment obtained by simulation. The dimensions in the shape of the glass antenna 2 illustrated in FIG. 7A were as follows (in units of mm):

L16: 45.0,
L17: 14.0,
W16, W17: 2,
L27B: 25.0,
W27B: 57.1,
L21B: 56.3,
L22B: 45.6,
L23B: 47.9,
L24B: 40.2,
L25: 63.8,
W21B, W22B, W23B, W24B: 4,
Vertical length of the metallic film 30B: 50,
Horizontal length of the metallic film 30B: 166,
H28 (vertical length of the notch portion 28): 4.0, and
W28 (horizontal length of the notch portion 28): 5.0.

The size of the notch portion 29 was made to be the same as the notch portion 28.

Also in the third example, at the predetermined three frequencies in the frequency band of Band 1 (in the above example, 0.725 GHz, 0.815 GHz and 0.915 GHz), four slot lengths L21B, L22B, L23B and L24B of the respective slots 21B, 22B, 23B and 24B having the dimensions of the glass antenna 2 influence one another, to radiate an electromagnetic field, and thereby particularly satisfactory impedance matching can be performed.

As illustrated in FIG. 23, in the simulation for the glass antenna 2, the return loss in the desired frequency bands, Band 1 to Band 3, was about less than or equal to −7 dB, and a desired antenna performance can be obtained in the desired frequency band.

Fourth Example

Figure 24:
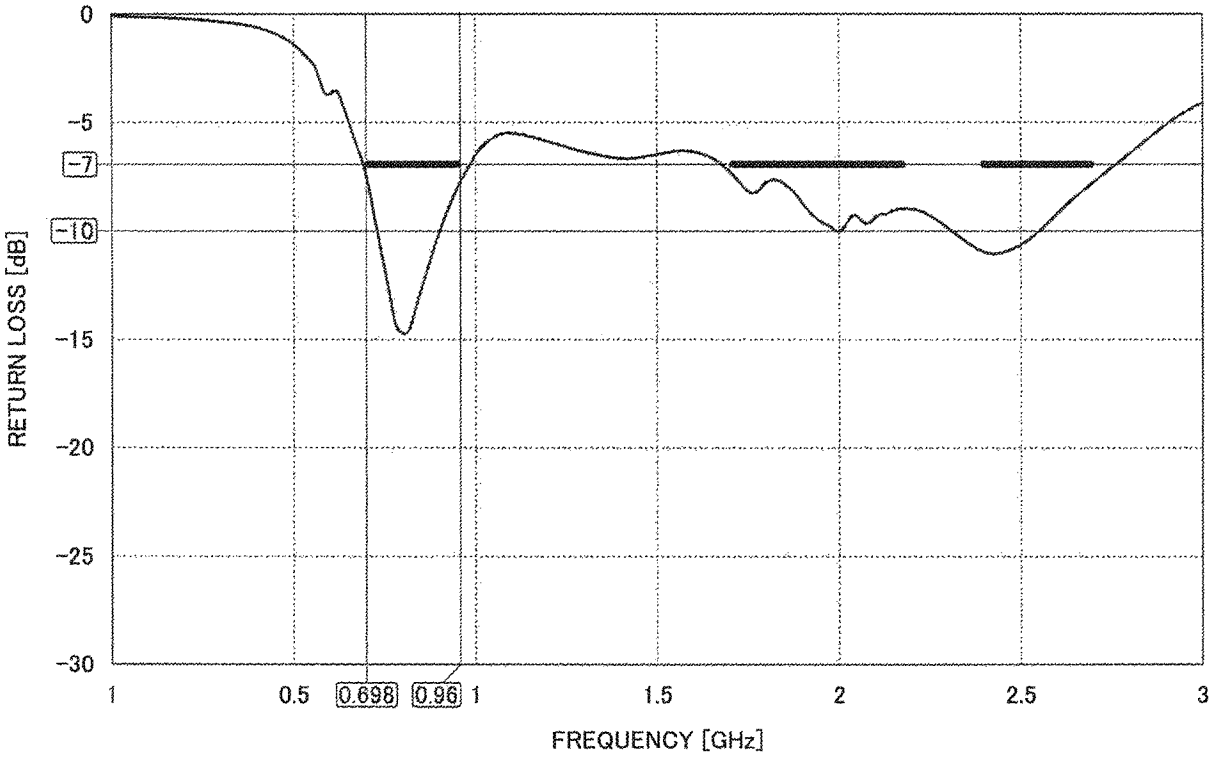
FIG. 24 is a diagram depicting a graph showing a return loss obtained by a simulation for the glass antenna according to the fourth embodiment.

FIG. 24 is a diagram depicting a graph showing a return loss obtained by simulation for the glass antenna 3 according to the fourth embodiment.

The dimensions in the shape of the glass antenna 3 illustrated in FIG. 24 were as follows (in units of mm):

L16C: 100.4,
W16C: 1.8,
L21C: 97.9,
L22C: 96.3,
L23C: 108.7,
L27C: 40.7,
W27C: 25.4,
W21C: 9.7,
W22C: 13.7,
W23C: 8.2,
Vertical length of the metallic film 30C: 130, and
Horizontal length of the metallic film 30C: 350.

In the fourth example, the respective wide slots 21C, 22C, and 23C of the glass antenna 3 influence one another, to radiate an electro-magnetic field, and thereby satisfactory impedance matching can be performed in the specific frequency band.

As illustrated in FIG. 24, in the simulation for the glass antenna 3, the return loss in the desired frequency bands, Band 1 to Band 3, was about less than or equal to −7 dB, and a desired antenna performance can be obtained in the desired frequency band.

Fifth Example

<Return Loss by Actual Measurement According to First Embodiment>

Figure 22:
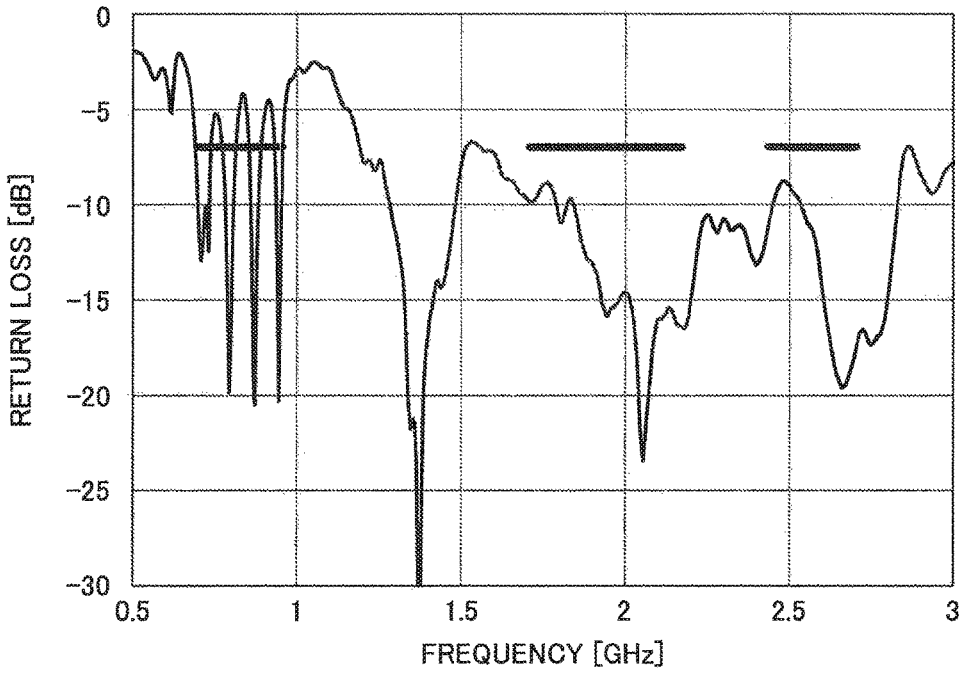
FIG. 22 is a diagram depicting a graph showing a measured value of the return loss in the glass antenna according to the first embodiment.

FIG. 22 is a diagram depicting a graph showing a return loss by actual measurement in the glass antenna according to the first embodiment. The return loss shown in FIGS. 11, 23 and 24 were the results of simulation for the configuration in which a glass antenna was arranged on a glass plate representing a simple glass, separately from a vehicle. In FIG. 22, a window glass 60 was mounted in an actual vehicle chassis 70, the glass antenna 1 was arranged on the window glass 60, and the return loss was measured.

The dimensions of the glass antenna 1 were made to be the same as the first example.

In the measurement, the position where the glass antenna 1 was arranged on the window glass 60 was determined as follows: a distance from the lower edge portion 71*c* of the vehicle chassis 70 to a lower edge of the metallic film 30 was 4 mm, and a distance from a side edge portion 71*b* of the vehicle chassis 70 to a side edge of the metallic film 30 was 58.9 mm.

As shown in FIG. 22, the antenna performance in Band 1 to Band 3 for the desired frequency bands is approximately less than or equal to −7 dB, and approximately satisfies the requirement to return loss in the desired frequency bands.

Assuming that a wavelength of an electric wave in the air at a central frequency in the frequency band is X, a wavelength contraction rate is k, and a wavelength of an electric wave propagating in the glass is $\lambda_g$, i.e. $\lambda g=\lambda \cdot k$, at the predetermined four frequencies in the frequency band, Band 1 (in the above example, 0.698 GHz, 0.8125 GHz, 0.8825 GHz and 0.945 GHz), slot lengths L21, L22, L23 and L24 of the respective slots 21, 22, 23 and 24 of the dimensions of the glass antenna 1 used in the second example correspond to a range of $0.21\lambda q$ to $0.23\lambda_g$, and are thus set to fall within a range from $\frac{1}{6}\lambda q$ to $\frac{1}{3}\lambda_g$. Thus, for the predetermined frequencies, a particularly excellent impedance matching is performed.

Moreover, similarly, at a predetermined single frequency in the frequency band of Band 1 (in the above example, 0.7525 GHz), slot lengths L14, L15 of the island shaped slots 14, 15 correspond to $0.47\lambda_g$, and are thus set to fall within a range of $0.4\lambda_g$ to $0.6\lambda_g$. Thus, as illustrated in FIG. 22, for the frequency, a particularly excellent impedance matching is performed.

Even when an actual measurement is performed for the glass antenna 1 with the configuration of being arranged in the vehicle chassis 70, similarly to the simulation for a simple glass, a desired return loss can be obtained.

Sixth Example

<Antenna Gain by Actual Measurement According to First Embodiment>

For the glass antenna for vehicle prepared by attaching to an actual vehicle window glass (rear glass) having the above-described configuration of glass antenna, results of actual measurement for an antenna gain will be described.

Figure 25:
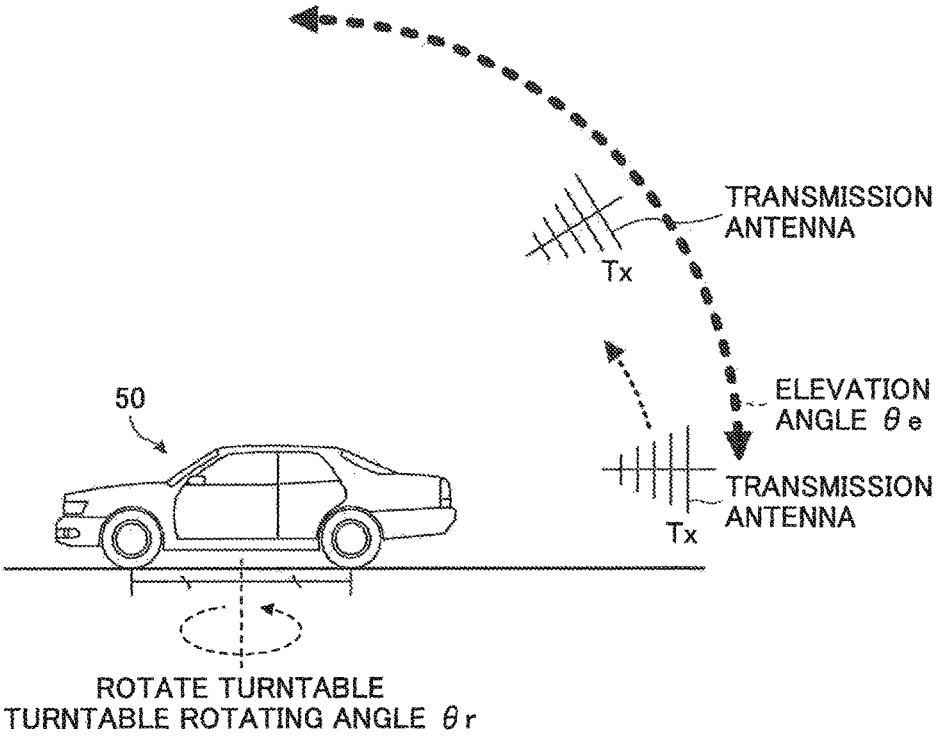
FIG. 25 is a diagram illustrating a status of the vehicle and the transmission antenna used for measurement.

FIG. 25 is a diagram schematically illustrating a condition for measurement, and depicting a status of a vehicle 50 and a transmission antenna Tx used in the measurement. The antenna gain was actually measured for a vehicle window glass, on which a glass antenna is formed, assembled into a window frame of a vehicle on a turntable. At this time, the window glass was inclined at an angle of about 20° with respect to the horizontal plane.

The measurement was performed by setting left-right, fore-aft wheel axis centers of the vehicle 50, to which the vehicle window glass with the glass antenna was assembled, to a center of the turntable, and by rotating the vehicle in the horizontal direction by an angle $\theta_r$ up to 360°.

An antenna gain was measured within a predetermined frequency range every 10 MHz for frequency, every 2 degrees for turntable rotating angle $\theta_r$ from 0° to 360°, and every 2 degrees for transmission elevation angle $\theta_e$ from 0° to 30°. The elevation angle was defined so that a direction parallel to the ground surface was $\theta_e$=0°, and the zenith direction was $\theta_e$=90°. The antenna gain was indicated with an absolute gain by calibrating in advance the measurement system using a standard gain antenna.

Figure 26:
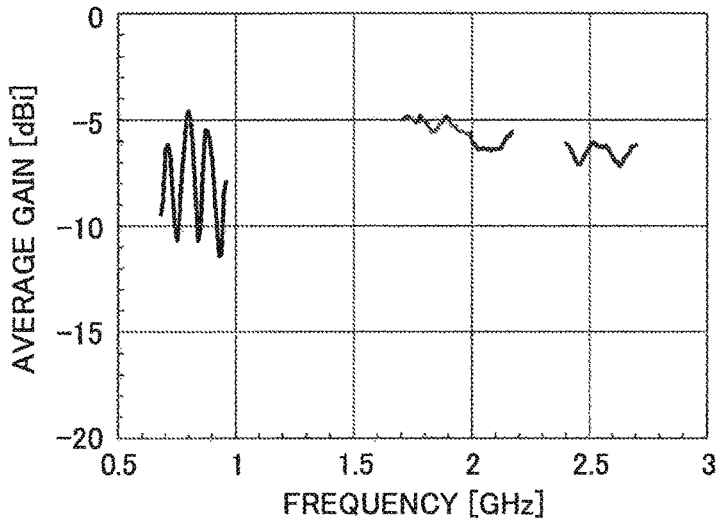
FIG. 26 is a diagram depicting a graph showing gain characteristics of a vertically polarized wave in the glass antenna according to the first embodiment.
Figure 27:
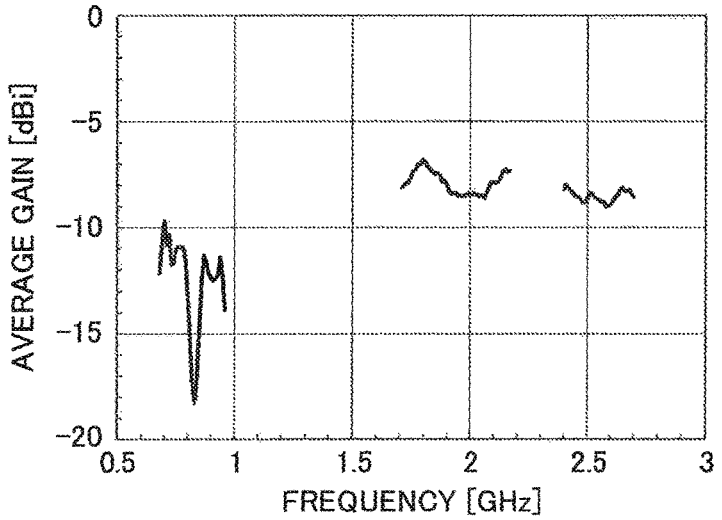
FIG. 27 is a diagram depicting a graph showing gain characteristics of a horizontally polarized wave in the glass antenna according to the first embodiment.

FIG. 26 shows a gain when a vertically polarized wave from the transmission antenna Tx was received by the glass antenna 1 (results of measurement for gain averaged over all rotational angles (whole circumferential) and all elevation angles). FIG. 27 shows a gain when a horizontally polarized wave from the transmission antenna Tx was received by the glass antenna 1. More specifically, the gain was measured for each elevation angle $\theta_e$ of the transmission antenna Tx, i.e. every 2° from 0° to 30°, rotating the vehicle 50 in the horizontal direction by $\theta_r$ up to 360° (every 2° from 0° to 360° (whole circumferential)), and averaging the measured data with respect to the rotating angle $\theta_r$ and the elevation angle $\theta_e$.

In the measurement for the gain shown in FIG. 26 and FIG. 27 in the present invention, the dimensions in the shape of the glass antenna 1 according to the first embodiment, illustrated in FIG. 5, were the same as in the second example.

In the sixth example, as an example, for the resistor 9, a resistor of a resistance value of 100 kΩ with an error of ±5% (resistor module element) was used. Moreover, for the power supply unit 7, the on-glass connector for connecting coaxial cable 8 was used by soldering the connector.

TABLE 1 shows average gains for vertically polarized waves received by the glass antenna 1 for communication waves in the three bands, as shown in FIG. 26, among the bands used as the LTE, i.e. 0.698 GHz to 0.96 GHz (Band 1), 1.71 GHz to 2.17 GHz (Band 2) and 2.4 GHz to 2.69 GHz (Band 3), and an average value of the gains of the three bands (arithmetic average value) denoted as "3 Band Average".

TABLE 1

| | Vertical polarization | | | |
|---|---|---|---|---|
| | Band 1 (0.698 to 0.96 GHz) | Band 2 (1.71 to 2.17 GHz) | Band 3 (2.4 to 2.69 GHz) | 3 band average |
| Average Gain (dBi) | −7.4 | −5.6 | −6.5 | −6.4 |

TABLE 2 shows average gains for horizontally polarized waves received by the glass antenna 1 for the communication waves in the three bands and an average value of the gains of the three bands.

TABLE 2

| | Horizontal polarization | | | |
|---|---|---|---|---|
| | Band 1 (0.698 to 0.96 GHz) | Band 2 (1.71 to 2.17 GHz) | Band 3 (2.4 to 2.69 GHz) | 3 band average |
| Average Gain (dBi) | −12.2 | −7.8 | −8.5 | −9.1 |

As can be seen from FIG. 26, FIG. 27, TABLE 1 and TABLE 2, in the glass antenna 1 according to the present invention, an average gain in three bands, Band 1, Band 2 and Band 3, i.e. an average value of the gains in the three bands is greater than or equal to −10 dBi, and an excellent average gain for receiving a vertically polarized wave and a horizontally polarized wave can be obtained.

Seventh Example

<Return Loss by Actual Measurement According to Fifth Embodiment>

Figure 28:
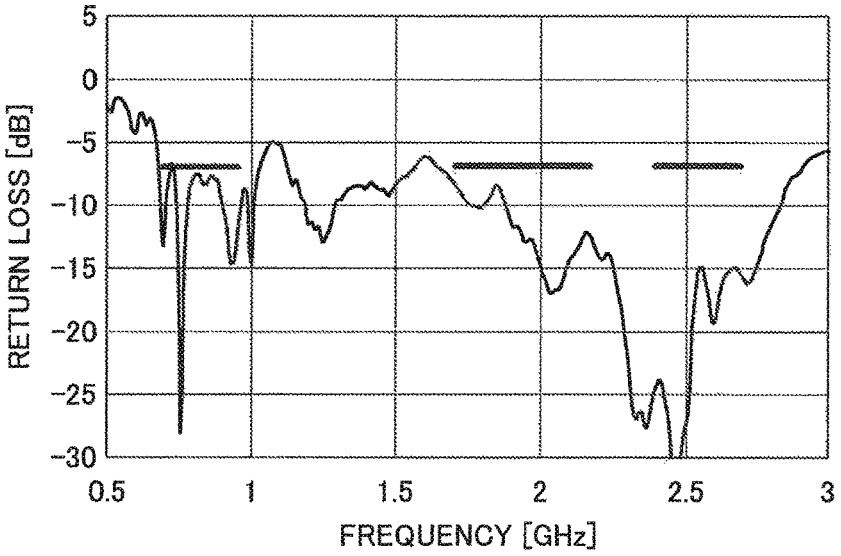
FIG. 28 is a diagram depicting a graph showing a measured value of the return loss in the glass antenna according to the fifth embodiment.

FIG. 28 is a diagram depicting a graph showing a measured value of a return loss for the glass antenna 4 according to the fifth embodiment. In the seventh example, in the same way as FIG. 22 in the fifth example, a window glass 60 was mounted in an actual vehicle chassis 70, the glass antenna 4 was arranged on the window glass 60, and the return loss was measured. In addition, the vehicle was a different type of vehicle from the vehicle illustrated in FIG. 25.

The dimensions of the glass antenna 4 were set as follows:

L11D (slot length): 42,
W11D (slot width): 1,
L12D: 28,
W12D: 2,
L13D: 37,
W13D (base length of triangle of triangle shaped slot): 20.2,
L27D: 46,
W27D: 7,
L21D: 29,
L22D: 40,
L23D: 37,
L24D: 39,
L25D: 62.0,
L26: 55.5,
W21D, W26: 6,
W22D, W23D, W24D, W25D: 6.3,
Width of ground side conductive body 31D: 20,
Width of core wire side conductive body 32D: 139,
Height of metallic film 30D: 50,
H28D (height of notch portion 28D): 8, and
W28D (width of notch portion 28D): 12.

In the measurement, the position where the glass antenna 4 was arranged on the window glass 60 was determined as follows: a distance from a lower edge of the window glass 60, which is along the lower edge portion 71*c* of the vehicle chassis 70, to a lower edge of the metallic film 30D was 53 mm, and a distance from a side edge of the window glass 60, which is along a right side edge portion 71*b* of the vehicle chassis 70, to a side edge of the metallic film 30D was 120 mm.

TABLE 3 shows a return loss (dB) at a predetermined frequency (GHz) extracted from the graph shown in FIG. 28. In TABLE 3, left columns show a return loss in the LTE frequency bands and right columns show a return loss at the ISM frequencies included in the LTE frequency bands.

TABLE 3

| LTE | | ISM | |
|---|---|---|---|
| frequency (GHz) | return loss (dB) | frequency (GHz) | return loss (dB) |
| 0.698 | −13.2 | 0.87 | −7.8 |
| 0.96 | −11.0 | 2.4 | −24.6 |
| 1.71 | −8.5 | 2.48 | −33.2 |
| 2.17 | −12.2 | | |
| 2.5 | −28.2 | | |
| 2.69 | −15.2 | | |

As shown in FIG. 28 and TABLE 3, in the glass antenna 4, in the frequency bands of Band 1 to Band 3, the return loss is less than or equal to −8 dB. Moreover, in the frequency band of the ISM, the return loss is less than or equal to −7 dB. Thus, it was found that a desired return loss can be obtained in the glass antenna 4, in a state being attached to a vehicle, in both sets of frequency bands: for Band 1 to Band 3 of the LTE, and for the ISM.

When an actual measurement was performed for the configuration in which the glass antenna 4 is arranged on the window glass (rear glass) 60 of the vehicle chassis 70, a desired antenna performance can be obtained in the frequency bands for Band 1 to Band 3, and for the ISM.

Eighth Example

<Return Loss by Actual Measurement According to Sixth Embodiment>

Figure 29:
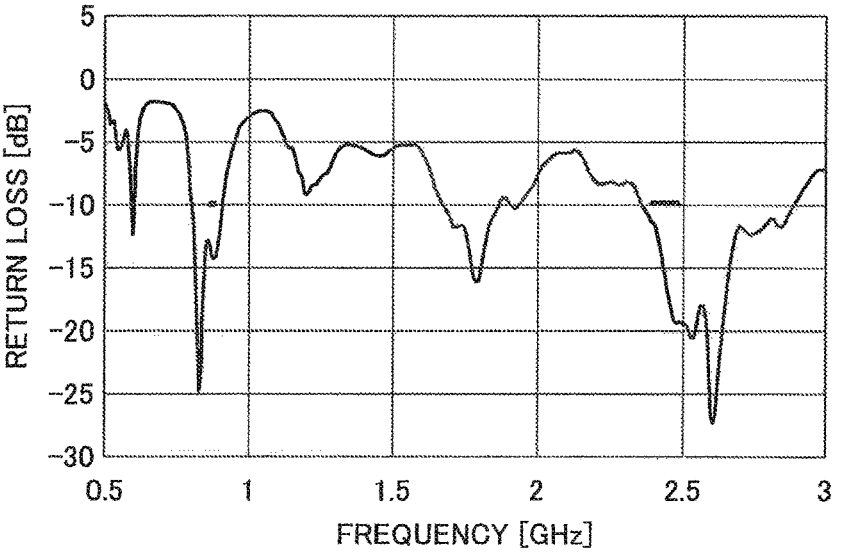
FIG. 29 is a diagram depicting a graph showing a measured value of the return loss in the glass antenna according to the sixth embodiment.

FIG. 29 is a diagram depicting a graph showing a measured value of a return loss for the glass antenna 5 according to the sixth embodiment. In the eighth example, in the same way as FIG. 22 in the fifth example, a window glass 60 was mounted in an actual vehicle chassis 70, the glass antenna 5 was arranged on the window glass 60, and the return loss was measured. In addition, the vehicle was of a different type of vehicle from the vehicle illustrated in FIG. 25.

The dimensions of the glass antenna 5 were set as follows:

L11E (slot length): 42,
W11E (slot width): 1,
L12E: 19,
W12E: 2,
L13E: 40,
W13E (base length of triangle of triangle shaped slot): 30,
L27E: 30,
W27E: 5,
L21E: 41.5,
L22E: 44,
W21E, W22E: 4,
Horizontal length of ground side conductive body 31E: 20,
Horizontal length of core wire side conductive body 32E: 139,
Height of metallic film 30E: 50,
Vertical length of extension part 33: 25,
Horizontal length of extension part 33: 10,
Height of notch portion 28E: 8, and
Width of notch portion 28E: 19.

In the measurement, the position where the glass antenna 5 was arranged on the window glass 60 was determined as follows: a distance from a lower edge of the window glass 60, along the lower edge portion 71*c* of the vehicle chassis 70, to a lower edge of the metallic film 30E was 50 mm, and a distance from a side edge of the window glass 60, along a left side edge portion 71*d* of the vehicle chassis 70, to a side edge of the metallic film 30E was 103 mm.

TABLE 4 shows a return loss (dB) at a predetermined frequency (GHz) extracted from the graph shown in FIG. 29. In TABLE 4, left columns show a return loss in the LTE frequency bands and right columns show a return loss at the ISM frequencies included in the LTE frequency bands.

TABLE 4

| LTE | | ISM | |
|---|---|---|---|
| frequency (GHz) | return loss (dB) | frequency (GHz) | return loss (dB) |
| 0.698 | −1.9 | 0.87 | −14.0 |
| 0.96 | −4.2 | 2.4 | −11.5 |
| 1.71 | −11.8 | 2.48 | −19.4 |
| 2.17 | −7.2 | | |
| 2.5 | −19.3 | | |
| 2.69 | −11.9 | | |

As shown in FIG. 29 and TABLE 4, in the glass antenna 5, in the frequency band of Band 1 to Band 3, except the values for 0.698 GHz and of 0.96 GHz, the return loss is less than or equal to −7 dB. Moreover, in the frequency band of the ISM, the return loss is less than or equal to −11 dB. Thus, it was found that if the glass antenna 5 was dedicated to the ISM frequency band, an excellent return loss could be obtained.

When an actual measurement was performed for the configuration in which the glass antenna 5 is arranged on the window glass (rear glass) 60 of the vehicle chassis 70, an excellent antenna performance can be obtained in the frequency bands of the ISM.

In addition, typically, a communication wave has a high tolerance of noise, frequency of the communication wave is higher than a broadcast wave, and the frequency is substantially different from that of signals used in an electronic device. Thus, even if the glass antenna is arranged near a wiper or the like, a return loss and a value of a gain will not be appreciably affected.

As described above, the antenna system has been described by the embodiments and examples. The present invention is not limited to the embodiments or examples. Various variations and improvements, such as combination/replacement with/by a part or a whole of the other embodiment or example may be made without departing from the scope of the present invention.

REFERENCE SIGNS LIST

1, 1A, 2, 3, 4, 5 glass antenna
10 cutout portion
11 power supply slot
12 linear connection slot (connection slot)
13 triangular slot (connection slot)
19 connection slot
14 island shaped slot (two-sided slot)
15 island shaped slot (two-sided slot)
18 two-sided island shaped slot
16, 16C power supply slot
20, 20B, 20C, 20D, 20E comb-tooth slot
21, 21B, 21C, 21D, 21E first slot
22, 22B, 22C, 22D, 22E second slot
23, 23B, 23C, 23D, 23E third slot
24, 24B, 24D fourth slot
25, 25D fifth slot
26 sixth slot
27, 27B, 27C, 27D, 27E root slot
28, 28D, 28E notch portion
29 notch portion
30, 30B, 30C, 30D, 30E metallic film (conductive film)
31, 31B, 31D, 31E ground side conductive body
32, 32A, 32B, 32D, 32E core wire side conductive body
7, 7D, 7E power supply unit
8, 8D, 8E on-glass connector for connecting coaxial cable (connector)
8*c*, 8*c*D, 8*c*E coaxial cable
8*s*, 8*s*D, 8*s*E solder
9, 9D, 9E resistor
40 defogger
41 bus bar
42 heater wire (heating wire)
50 vehicle
60 window glass (rear glass, vehicle window glass)
61 outer periphery of window glass
65 shielding film
70 vehicle chassis
71*b*, 71*d* side edge portion of vehicle chassis
71*c* lower edge portion of vehicle chassis

What is claimed is:

1. A glass antenna arranged on a vehicle window glass comprising:

a slot antenna formed by cutting out a conductive film; and a pair of power supply units for supplying power to the slot antenna, wherein the slot antenna includes a power supply slot extended in a first direction and arranged so that the pair of power supply units straddle the power supply slot, a plurality of comb-tooth slots extended in a second direction, and a root slot extended in a third direction, the root slot being connected directly to the power supply slot or being connected to the power supply slot via a connection slot, and end portions of the plurality of comb-tooth slots being connected to the root slot.

2. The glass antenna according to claim 1, wherein slot lengths of the plurality of comb-tooth slots are different from each other.

3. The glass antenna according to claim 1, wherein the power supply slot is connected to the root slot via the connection slot, wherein the first direction in which the power supply slot extends and the third direction in which the root slot extends are approximately vertical directions, and wherein the second direction in which the comb-tooth slot extends and a direction in which the connection slot extends are approximately horizontal directions.

4. The glass antenna according to claim 3, wherein for the vehicle window glass being installed in an opening of a vehicle chassis, the glass antenna is located at a position near a corner portion between a lower edge portion of the opening and a side edge portion of the opening connected to the lower edge portion, wherein the power supply slot extending in the approximately vertical direction has an opening upward and an opening downward, wherein a part of the conductive film closer to the side edge portion, which is arranged adjacent to the conductive film, than the power supply slot functions as a ground side conductive body, and a part of the conductive film farther from the side edge portion, which is arranged adjacent to the conductive film, than the power supply slot functions as a core wire side conductive body, and the pair of power supply units, which are arranged so as to straddle the power supply slot, supply power to the ground side conductive body and the core wire side conductive body.

5. The glass antenna according to claim 4, wherein the connection slot includes a linear connection slot connected to the power supply slot, extending in a fourth direction that is different from the first direction, and having a constant slot width, and a triangular slot arranged between the linear connection slot and the root slot, and wherein a slot width of the triangular slot is the greatest at a part connected to the linear connection slot and the slot width gradually decreases toward the root slot.

6. The glass antenna according to claim 5, wherein a shape of the triangular slot is an isosceles triangle.

7. The glass antenna according to claim 4, wherein the plurality of comb-tooth slots include a lower part comb-tooth slot connected to a lower end of the root slot, and an upper part comb-tooth slot connected to an upper end of the root slot.

8. The glass antenna according to claim 7, wherein the plurality of comb-tooth slots include a central part comb-tooth slot or a plurality of central part comb-tooth slots between the lower part comb-tooth slot and the upper part comb-tooth slot.

9. The glass antenna according to claim 4, wherein a slot length of each of the plurality of comb-tooth slots is a length for which an impedance matching can be performed at a frequency within a frequency band of 0.698 GHz to 0.96 GHz.

10. The glass antenna according to claim 4, further comprising:

two island shaped slots arranged so as to interpose in a vertical direction the connection slot, the root slot and the comb-tooth slots between the two island shaped slots, and extending in an approximately horizontal direction.

11. The glass antenna according to claim 10, wherein at least one of slot lengths of the island shaped slots is a length for which an impedance matching can be performed at one predetermined frequency within a frequency band of 0.698 GHz to 0.96 GHz.

12. The glass antenna according to claim 4, wherein in the core wire side conductive body, a notch portion is arranged adjacent to the pair of power supply units so as to contact the power supply slot.

13. The glass antenna according to claim 4, further comprising:

a resistor arranged on the glass antenna, the resistor being connected to the glass antenna so as to straddle the power supply slot, wherein for a position where the pair of power supply units are arranged so as to straddle the power supply slot being higher than the connection slot, the resistor is connected to the glass antenna so as to straddle the power supply slot at a position lower than the connection slot, and wherein for the position where the pair of power supply units are arranged so as to straddle the power supply slot being lower than the connection slot, the resistor is connected to the glass antenna so as to straddle the power supply slot at a position higher than the connection slot.

14. The glass antenna according to claim 13, wherein in the ground side conductive body, a part where the resistor is arranged is formed to be greater than other parts.

15. The glass antenna according to claim 1, wherein the power supply slot is directly connected to the root slot, and wherein the first direction in which the power supply slot extends is an approximately horizontal direction.

16. The glass antenna according to claim 1, wherein the glass antenna can transmit/receive a communication wave over frequency bands of 0.698 GHz to 0.96 GHz, 1.710 GHz to 2.17 GHz, and 2.4 GHz to 2.69 GHz.

17. A vehicle window glass provided with the glass antenna according to claim 1.

18. The vehicle window glass according to claim 17, wherein the vehicle window glass installed in an opening of a vehicle chassis is a rearward window glass of a vehicle, the window glass being provided with a defogger having a plurality of heating wires extending in a vehicle width direction, and wherein the glass antenna is arranged between the lowermost heating wire and a lower edge portion of the opening of the vehicle chassis.

* * * * *